US010935919B2

(12) United States Patent
Hamano et al.

(10) Patent No.: US 10,935,919 B2
(45) Date of Patent: Mar. 2, 2021

(54) IMAGE FORMING APPARATUS

(71) Applicant: CANON KABUSHIKI KAISHA, Tokyo (JP)

(72) Inventors: Akira Hamano, Kashiwa (JP); Rin Ishikawa, Ushiku (JP); Takashi Tsujimura, Toride (JP); Yuichiro Imai, Tokyo (JP); Saimon Gokyu, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/561,869

(22) Filed: Sep. 5, 2019

(65) Prior Publication Data

US 2020/0081390 A1 Mar. 12, 2020

(30) Foreign Application Priority Data

Sep. 10, 2018 (JP) ..... JP2018-169153

(51) Int. Cl.
*G03G 15/01* (2006.01)
*G03G 15/00* (2006.01)
*G03G 15/16* (2006.01)

(52) U.S. Cl.
CPC ..... *G03G 15/6561* (2013.01); *G03G 15/0131* (2013.01); *G03G 15/1615* (2013.01)

(58) Field of Classification Search
CPC ..... G03G 15/01; G03G 15/0189; G03G 15/0131; G03G 15/1615; G03G 15/6561; G03G 15/5058; G03G 15/5033; G03G 2215/0158; G03G 2215/00037; G03G 2215/00059
USPC ..... 399/38–41, 49, 72, 297–302
See application file for complete search history.

(56) References Cited

U.S. PATENT DOCUMENTS

| | | | | |
|---|---|---|---|---|
| 7,978,995 | B2 * | 7/2011 | Isobe | G03G 15/0194 399/70 |
| 8,107,833 | B2 | 1/2012 | Yoshida | |
| 8,175,474 | B2 * | 5/2012 | Kinukawa | G03G 15/5058 399/49 |
| 8,958,730 | B2 * | 2/2015 | Miura | G03G 15/0189 399/301 |
| 9,091,987 | B2 * | 7/2015 | Ohmiya | G03G 15/0131 |
| 9,141,017 | B2 * | 9/2015 | Hayashi | G03G 15/0189 |
| 9,291,932 | B2 * | 3/2016 | Itoh | G03G 15/01 |
| 9,310,705 | B2 * | 4/2016 | Nakashima | G03G 15/0131 |

(Continued)

*Primary Examiner* — Hoan H Tran
(74) *Attorney, Agent, or Firm* — Venable LLP

(57) ABSTRACT

An image forming apparatus forms a plurality of images of different colors on an intermediate transfer belt by a plurality of image forming portions. The image forming apparatus detects a color misregistration amount of the image formed on the intermediate transfer belt and performs image formation using a correction value based on the color misregistration amount. If an elapsed time from previous image formation is less than a predetermined time, the image forming apparatus predicts the correction value using the previous correction value and the temperature at that time and performs color misregistration correction. If the elapsed time from the previous image formation is a predetermined time or longer, the image forming apparatus predicts the correction value using the correction value and the temperature at the time when the elapsed time becomes a predetermined time or longer and performs the color misregistration correction.

6 Claims, 12 Drawing Sheets

(56) References Cited

U.S. PATENT DOCUMENTS

| | | | | |
|---|---|---|---|---|
| 10,073,403 | B2 * | 9/2018 | Shiraishi | G03G 15/16 |
| 10,254,699 | B2 * | 4/2019 | Kanno | G03G 15/6564 |
| 10,341,502 | B2 * | 7/2019 | Mima | H04N 1/0009 |

* cited by examiner

IMAGE FORMING APPARATUS

BACKGROUND OF THE INVENTION

Field of the Invention

The present disclosure relates to an image forming apparatus such as a laser printer, a digital copier and the like which performs image formation by scanning a laser beam.

Description of the Related Art

An image forming apparatus which forms a color image by an electrophotographic system includes a plurality of image forming portions for increasing speed. Each image forming portion forms an image of a corresponding color on a photoreceptor by, for example, each step of charging, exposure, and development. The image formed on the photoreceptor of each image forming portion is sequentially superimposed on and transferred to a transfer member and a sheet, and a full-color image is formed. In such an image forming apparatus, a laser scanner is used to expose the photoreceptor. The laser scanner exposes the photoreceptor by deflecting a laser beam by a deflector. The deflector generates heat. In the laser scanner, due to the heat generated by the deflector, optical components such as a lens, a mirror and the like are deformed, or a position or an attitude of the optical component changes. These changes of the optical system result in deviation of an irradiation position of the laser beam. The deviation of the irradiation position causes the deviation between images when the images of the respective colors are superimposed. Due to the deviation between images, color misregistration occurs in the color image.

The image forming apparatus performs color misregistration correction to the color misregistration. The color misregistration correction is performed by forming a detection image for detecting color misregistration on a transfer member to which the image is transferred from the photoreceptor, by detecting a color misregistration correction value by reading the detection image by a sensor, and by adjusting image-writing start timing and the like according to the color misregistration correction value. The image-writing start timing is timing to start the exposure of the photoreceptor with the laser scanner. The color misregistration correction is hereinafter referred to as "auto registration".

The auto registration is performed at appropriate time intervals or for every predetermined number of sheets on which the image formation is performed. In particular, as an influence of hysteresis of temperature rise and fall between at the time of first image formation of a day and at the time of image formation of a previous night is large, necessity to perform the auto registration increases. Frequent auto-registration leads to increased downtime. Practically, a state in the image forming apparatus when a power source is turned on is often similar to that when the power source is previously turned on. Thus, U.S. Pat. No. 8,107,833 B2 proposes an image forming apparatus in which, if a difference with a temperature of the image forming apparatus when the power source is previously turned on is less than a predetermined temperature, the color misregistration correction value when the power source is previously turned on is used, and if the difference is a predetermined temperature or more, a new color misregistration value is detected.

Timing to turn on the power source of the image forming apparatus varies depending on the day. Thus, a temperature outside the image forming apparatus and a temperature inside the image forming apparatus also vary. The variation in the temperature directly influences a color misregistration amount so that correction residual due to the color misregistration correction becomes large. If the correction residual is unacceptably large, frequency to perform the auto registration increases. A conventional image forming apparatus determines whether to perform the auto registration when the power source is turned on. In an actual operation, the image forming apparatus also performs the auto registration after the image forming apparatus is left unoperated for a long time. Thus, an image forming apparatus which reduces the frequency to perform the auto registration to reduce the downtime is desired.

SUMMARY OF THE INVENTION

An image forming apparatus according to the present disclosure includes: a plurality of image forming units configured to form a plurality of images of different colors; an intermediate transfer member to which the images are transferred; a transfer portion to which the images are transferred from the intermediate transfer member to a sheet; a sensor configured to measure color patterns on the intermediate transfer member, the color patterns being used to detect color misregistration; a detector configured to detect a temperature; a controller configured to control the plurality of image forming units to form color patterns of different colors, control the sensor to measure the color patterns, detect the color misregistration on the basis of a measurement result of the sensor, control a relative position of images to be formed by the plurality of image forming units on the basis of the detected color misregistration and a detection result of the detector; and a memory configured to store reference color misregistration, wherein the controller controls, without forming the color patterns, the relative position on the basis of the reference color misregistration stored in the memory and a detection result of the detector in a case where (i) an elapsed time from previous output image formation on the sheet by the image forming apparatus is longer than a predetermined time and (ii) a predetermined condition relating to a temperature of the image forming apparatus is satisfied.

Further features of the present invention will become apparent from the following description of exemplary embodiments (with reference to the attached drawings).

DESCRIPTION OF THE EMBODIMENTS

In the following, embodiments of the present disclosure will be described in detail with reference to the drawings.

Configuration of Image Forming Apparatus

Figure 1:
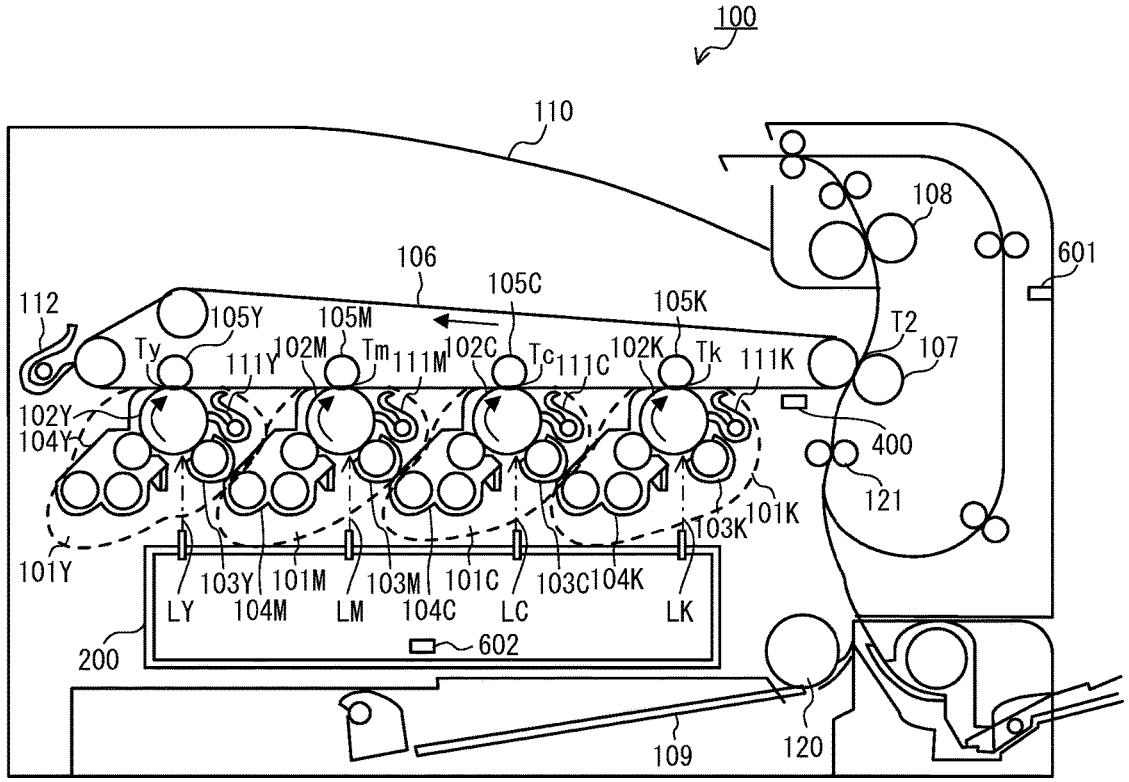
FIG. 1 is a diagram showing a configuration of an image forming apparatus.

FIG. 1 is a diagram showing a configuration of an electrophotographic image forming apparatus. An image forming apparatus 100 includes four image forming portions 101Y, 101M, 101C, and 101K, a laser scanner 200, an intermediate transfer belt 106, a fixing device 108, and a sheet feeding mechanism. The image forming portion 101Y is an image forming part for forming a toner image of yellow (Y). The image forming portion 101M is an image forming part for forming a toner image of magenta (M). The image forming portion 101C is an image forming part for forming a toner image of cyan (C). The image forming portion 101K is an image forming part for forming a toner image of black (K). The sheet feeding mechanism feeds a sheet from a storage part 109 for storing a sheet to a discharge part 110. The image is formed on the sheet during conveyance. The laser scanner 200 is disposed between the image forming portions 101Y, 101M, 101C, and 101K and the storage part 109 in a vertical direction.

The image forming portions 101Y, 101M, 101C, and 101K are respectively provided with photosensitive drums 102Y, 102M, 102C, and 102K which are photoreceptors. The photosensitive drums 102Y, 102M, 102C, and 102K are arranged in parallel in a horizontal direction along the intermediate transfer belt 106. The photosensitive drums 102Y, 102M, 102C, and 102K rotate in a clockwise direction in FIG. 1. Transfer rollers 105Y, 105M, 105C, and 105K are provided at positions opposite to the photosensitive drums 102Y, 102M, 102C, and 102K with the intermediate transfer belt 106 interposed therebetween. Transfer parts Ty, Tm, Tc, and Tk are formed between the photosensitive drums 102Y, 102M, 102C, and 102K and the transfer rollers 105Y, 105M, 105C, and 105K.

Chargers 103Y, 103M, 103C, and 103K, developing devices 104Y, 104M, 104C, and 104K, and drum cleaners 111Y, 111M, 111C, and 111K are provided around the photosensitive drums 102Y, 102M, 102C, and 102K along a rotation direction. The chargers 103Y, 103M, 103C, and 103K uniformly charge surfaces of the corresponding photosensitive drums 102Y, 102M, 102C, and 102K. When the charged photosensitive drums 102Y, 102M, 102C, and 102K are exposed by the laser scanner 200, electrostatic latent images are formed on the surfaces. The laser scanner 200 emits optical beams (laser beams) LY, LM, LC, and LK. The laser scanner 200 scans the photosensitive drums 102Y 102M, 102C, and 102K with the laser beams LY, LM, LC, and LK to form the electrostatic latent images.

The developing devices 104Y, 104M, 104C, and 104K develop the electrostatic latent images formed on the photosensitive drums 102Y, 102M, 102C, and 102K with developer such as toners of corresponding colors. Thus, toner images of corresponding colors are formed on the photosensitive drums 102Y, 102M, 102C, and 102K. The toner images formed on the respective photosensitive drums 102Y, 102M, 102C, and 102K are transferred to the intermediate transfer belt 106 by the transfer rollers 105Y, 105M, 105C, and 105K in the transfer parts Ty, Tm, Tc, and Tk. The intermediate transfer belt 106 is an image carrier which rotates counterclockwise in FIG. 1. The toner images of the respective colors are transferred in order from an upstream side in the rotation direction. When the toner images corresponding to respective color components formed in the image forming portions 101Y, 101M, 101C, and 101K are sequentially superimposed on and transferred to the intermediate transfer belt 106, a full-color toner image is formed on the intermediate transfer belt 106. The intermediate transfer belt 106 carries the full-color toner image in this manner. The drum cleaners 111Y, 111M, 111C, and 111K remove the toner remaining on the photosensitive drums 102Y, 102M, 102C, and 102K after the transfer. By rotating, the intermediate transfer belt 106 conveys the toner image to the transfer part T2. The transfer part T2 corresponds to a position where the toner image is transferred from the intermediate transfer belt 106 to the sheet, and is provided on a conveying path which conveys the sheet.

The sheet is fed from the storage part 109 to the conveying path. The conveying path is provided with a sheet feeding roller 120, a registration roller 121, a transfer roller 107 which constitutes the transfer part T2, and the fixing device 108 in order from an upstream side in a sheet conveying direction. The sheet feeding roller 120 feeds the sheet one by one from the storage part 109 to the conveying path. The sheet feeding roller 120 conveys the sheet to the registration roller 121. The registration roller 121 performs a skew correction of the sheet and conveys the sheet to the transfer part T2 according to a timing at which the intermediate transfer belt 106 conveys the toner image to the transfer part T2.

When the toner image on the intermediate transfer belt 106 and the sheet enter the transfer part T2, the transfer roller 107 is applied with a transfer voltage. Due to this, the toner image on the intermediate transfer belt 106 is transferred to the sheet. The sheet having the toner image transferred thereto is conveyed to the fixing device 108. The fixing device 108 fixes the toner image on the sheet by conveying the sheet while heating. This finishes the image formation on the sheet. Thereafter, the sheet is discharged to the discharge part 110. It should be noted that a transfer member cleaner 112 is arranged near the intermediate transfer belt 106. The transfer member cleaner 112 has a blade which contacts with the intermediate transfer belt 106. The transfer member cleaner 112 cleans the intermediate transfer belt 106 by scraping the toner remaining on the intermediate transfer belt 106 after the transfer using the blade.

The image forming portions 101Y, 101M, 101C, and 101K, the intermediate transfer belt 106 and the transfer roller 107 as described above function as the image forming part, which is disposed between the storage part 109 and the discharge part 110 in a vertical direction.

The image forming apparatus 100 according to the present embodiment has a color misregistration correction function for correcting the color misregistration (deviation of image forming position) between images of different colors. To this end, the image forming apparatus 100 includes a color misregistration detection sensor 400 for detecting a detection image for detecting color misregistration (color pattern), described later, which is formed on the intermediate transfer belt 106. The detection image is formed including all color patterns (toner images) of yellow, magenta, cyan, and black. The color misregistration detection sensor 400 is arranged to detect the detection image at a position where the detection images of all four colors can be detected and a shape of the detection image is not deformed by a roller pressure of the transfer roller 107 of the transfer part T2.

The image forming apparatus 100 according to the present embodiment performs the color misregistration correction using a temperature change amount as a trigger. To this end, the image forming apparatus 100 includes a temperature sensor 601 for detecting an environmental temperature (temperature outside the apparatus) where the image forming apparatus 100 is installed and a temperature sensor 602 for detecting temperature inside the laser scanner 200. The image forming apparatus 100 determines whether the color misregistration correction can be performed or not depending on magnitude of the respective temperature change amounts of the temperature outside the apparatus and the temperature inside the laser scanner. It should be noted that the temperature sensor may be provided at a position where the temperature outside the apparatus and the temperature inside the apparatus can be detected. For example, the temperature sensor for detecting the temperature inside the apparatus may be provided on a substrate of the laser scanner 200, in the image forming portions 101Y, 101M, 101C, and 101K, in the fixing device 108 and the like. In this case, depending on the temperature change amount detected by these temperature sensors, the image forming apparatus 100 determines whether the color misregistration correction can be performed or not. Each temperature sensor is a temperature detection part.

Laser Scanner

Figure 2:
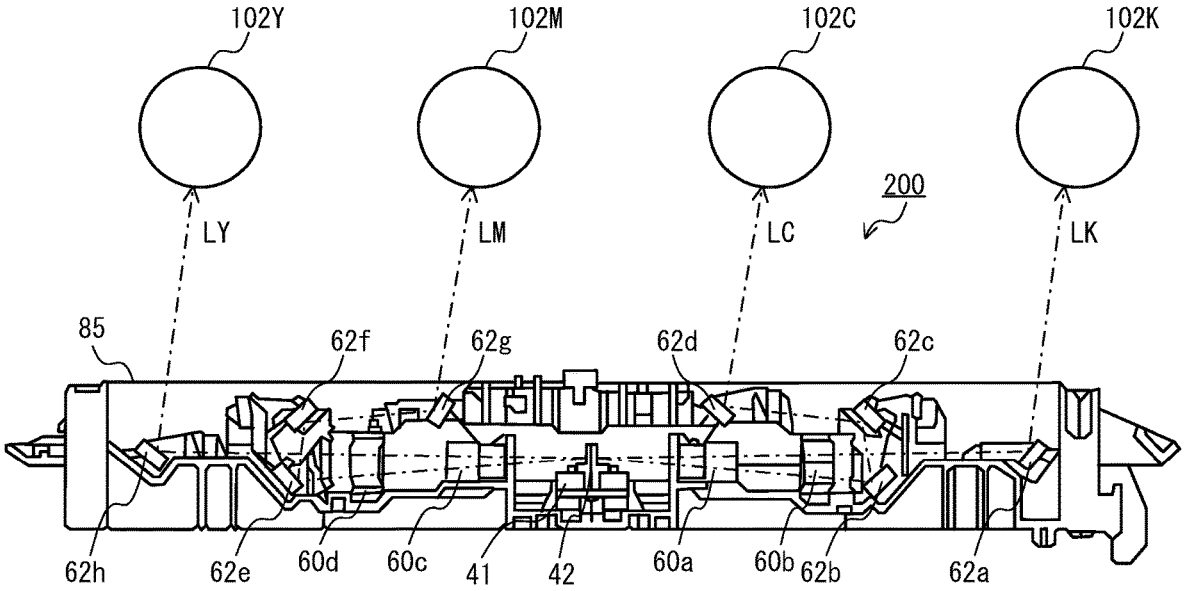
FIG. 2 is an explanatory view of a laser scanner.
Figure 3:
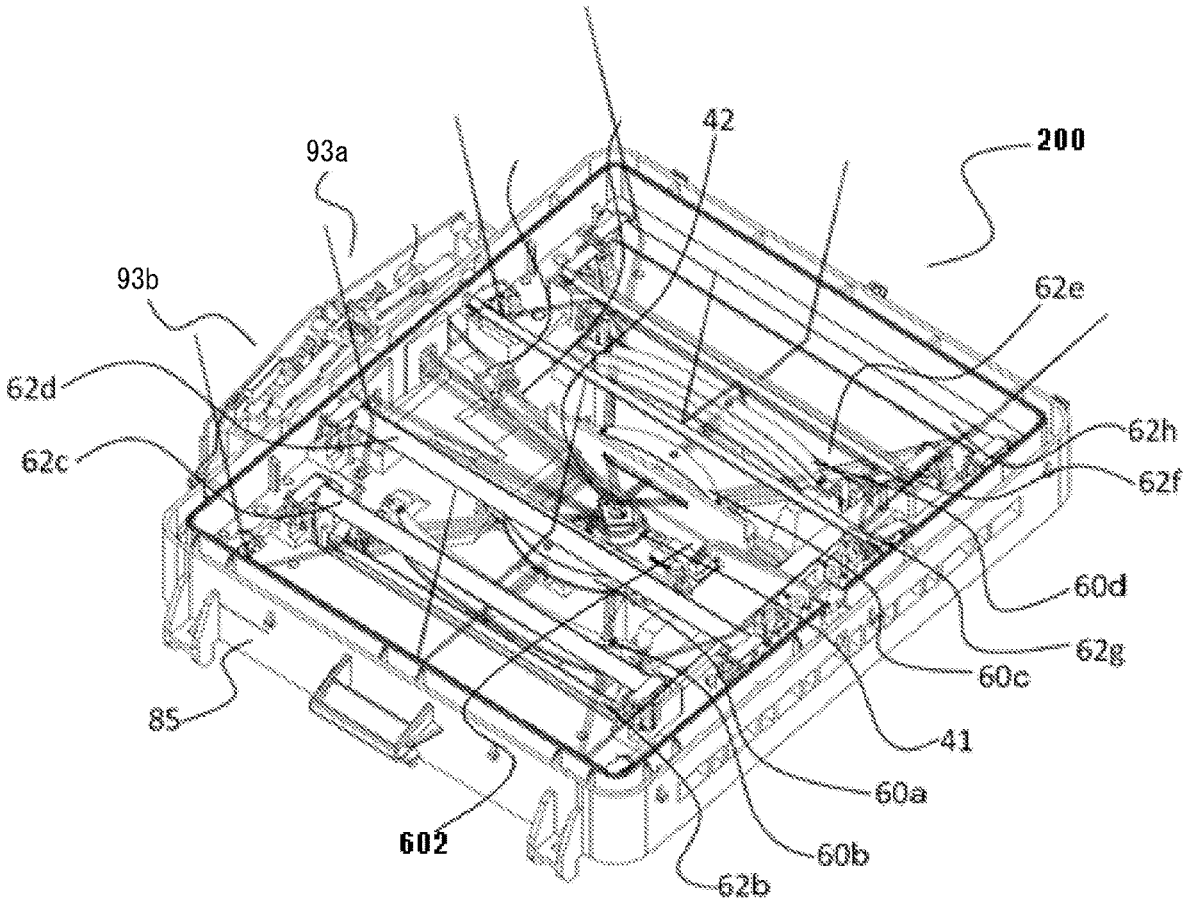
FIG. 3 is an explanatory view of a laser scanner.

FIG. 2 and FIG. 3 are explanatory views of the laser scanner 200. FIG. 2 is a cross-sectional view of the laser scanner 200, and FIG. 3 is a transparent perspective view of the laser scanner 200. Light source units 93*a* and 93*b* including a semiconductor laser (not shown) are disposed on a side surface of a housing 85 of the laser scanner 200 to expose the photosensitive drums 102Y, 102M, 102C, and 102K. The light source unit 93*a* includes a semiconductor laser for irradiating the photosensitive drums 102Y and 102M with the laser beams LY and LM. The light source unit 93*b* includes a semiconductor laser for irradiating the photosensitive drums 102C and 102K with the laser beams LC and LK. An opening is provided on a side wall of the housing 85. The semiconductor lasers of the light source units 93*a* and 93*b* are disposed at positions where the laser beams emitted enter the housing 85 via the opening.

The housing 85 is provided with a rotary polygon mirror (polygon mirror) 42, a drive motor 41 for rotating to drive the polygon mirror 42, and a deflection unit including a circuit board (not shown) for controlling the drive motor 41 therein. Moreover, the housing 85 is provided with an optical system including optical lenses 60*a* to 60*d* and reflection mirrors 62*a* to 62*h* therein. The laser beams emitted from the semiconductor lasers are guided to the photosensitive drums 102Y, 102M, 102C, and 102K via the housing 85.

The laser beam LK irradiated on the photosensitive drum 102K enters the housing 85 from the semiconductor laser in the light source unit 93*b*, is deflected by the polygon mirror 42, passes through the optical lenses 60*a* and 60*b*, and is reflected by the reflection mirror 62*a*. The laser beam LK reflected by the reflection mirror 62*a* passes through a transparent window (not shown) provided on the housing 85 and irradiates the photosensitive drum 102K. The laser beam LK scans the photosensitive drum 102K by variation of a deflection angle of the laser beam LK by a rotation of the polygon mirror 42.

The laser beam LC irradiated on the photosensitive drum 102C enters the housing 85 from the semiconductor laser in the light source unit 93*b*, is deflected by the polygon mirror 42, passes through the optical lenses 60*a* and 60*b*, and is reflected by the reflection mirrors 62*b*, 62*c*, and 62*d*. The laser beam LC reflected by the reflection mirror 62*d* passes through a transparent window (not shown) provided on the housing 85 and irradiates the photosensitive drum 102C. The laser beam LC scans the photosensitive drum 102C by variation of a deflection angle of the laser beam LC by the rotation of the polygon mirror 42.

The laser beam LM irradiated on the photosensitive drum 102M enters the housing 85 from the semiconductor laser in the light source unit 93*a*, is deflected by the polygon mirror 42, passes through the optical lenses 60*c* and 60*d*, and is reflected by the reflection mirrors 62*e*, 62*f*, and 62*g*. The laser beam LM reflected by the reflection mirror 62*g* passes through a transparent window (not shown) provided on the housing 85 and irradiates the photosensitive drum 102M. The laser beam LM scans the photosensitive drum 102M by variation of a deflection angle of the laser beam LM by the rotation of the polygon mirror 42.

The laser beam LY irradiated on the photosensitive drum 102Y enters the housing 85 from the semiconductor laser in the light source unit 93*a*, is deflected by the polygon mirror 42, passes through the optical lenses 60*c* and 60*d*, and is reflected by the reflection mirror 62*h*. The laser beam LY reflected by the reflection mirror 62*h* passes through a transparent window (not shown) provided on the housing 85 and irradiates the photosensitive drum 102Y. The laser beam LY scans the photosensitive drum 102Y by variation of a deflection angle of the laser beam LY by the rotation of the polygon mirror 42.

The laser beams LY, LM, LC, and LK emitted from the light source units 93*a* and 93*b* are guided to the photosensitive drums 102Y, 102M, 102C, and 102K by the polygon mirror 42 and the optical system in the housing 85 and imaged. The exposure positions where the laser beams LY, LM, LC, LK are imaged on the photosensitive drums 102Y, 102M, 102C, and 102K move according to the rotation of the polygon mirror 42. Thus, the photosensitive drums 102Y, 102M, 102C, and 102K are scanned by the laser beams LY, the LM, LC, and LK, respectively.

Description of Color Misregistration Correction

Figure 4:
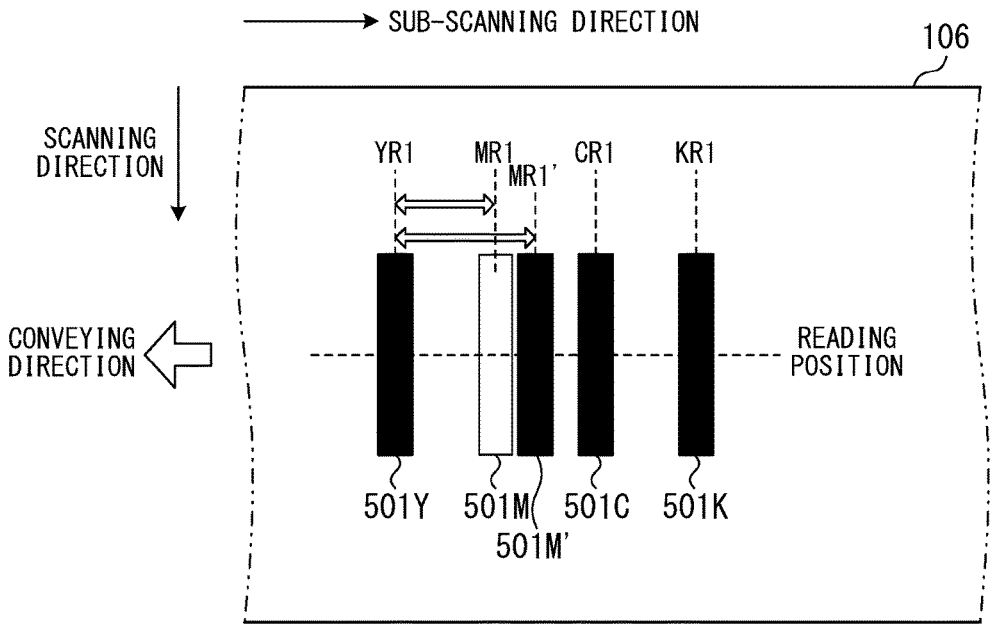
FIG. 4 is an explanatory view of a color misregistration correction in a sub-scanning direction.
Figure 5:
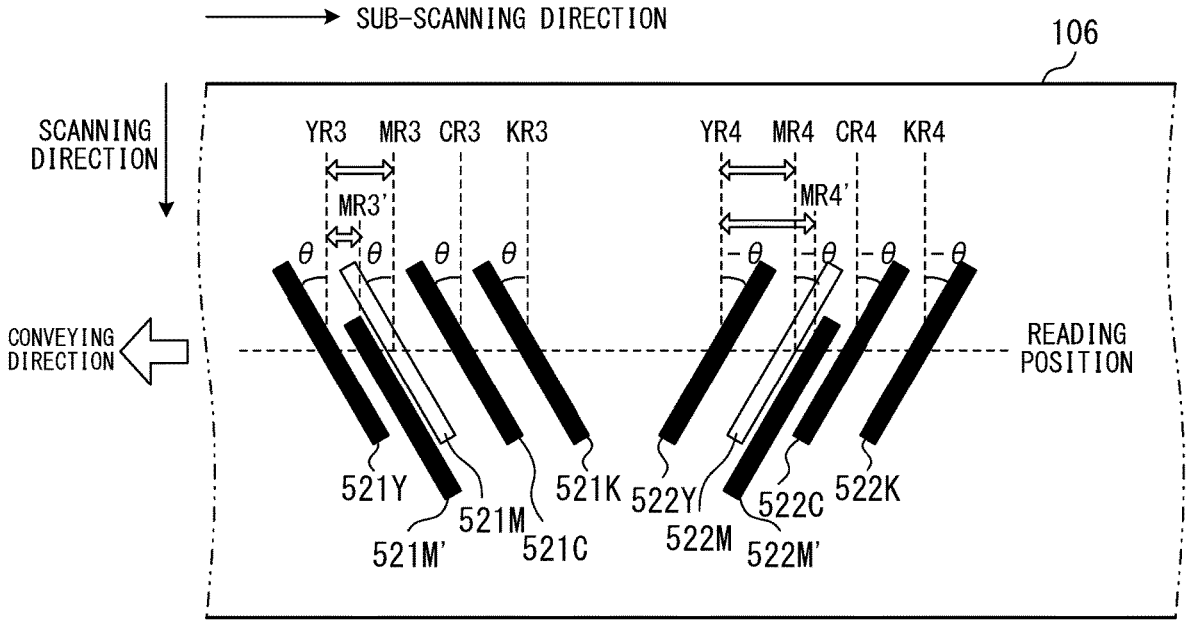
FIG. 5 is an explanatory view of a color misregistration correction in a main scanning direction.
Figure 6:
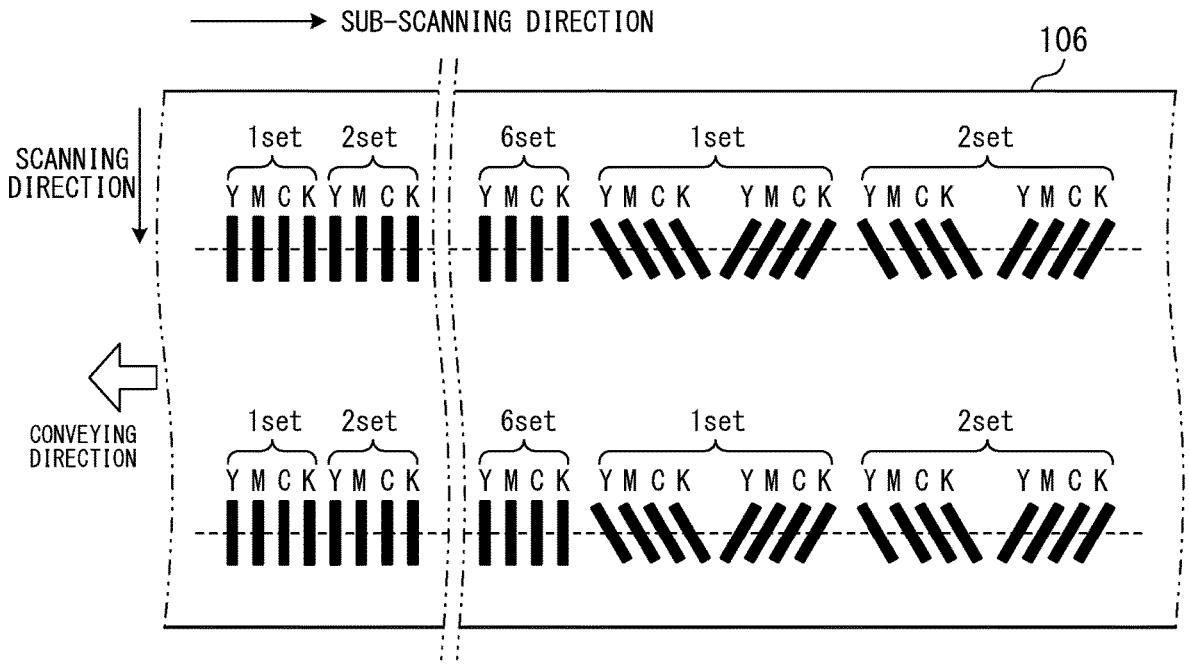
FIG. 6 is an illustration of a detection image for detecting color misregistration.

FIG. 4, FIG. 5, and FIG. 6 are explanatory views of the color misregistration correction of the present embodiment. It should be noted that, in the following description, a direction in which the laser scanner 200 scans the photosensitive drums 102Y, 102M, 102C, and 102K with the laser beams LY, LM, LC, and LK is a main scanning direction, and a direction which is orthogonal to the main scanning direction is a sub-scanning direction. The main scanning direction is a direction which is orthogonal to a direction (conveying direction) in which the intermediate transfer belt 106 rotates. The sub-scanning direction is a direction (conveying direction) in which the intermediate transfer belt 106 rotates.

FIG. 4 is an explanatory view of the color misregistration correction in the sub-scanning direction. The detection image for detecting color misregistration in the sub-scanning direction includes a yellow correction pattern 501Y, a magenta correction pattern 501M, a cyan correction pattern 501C, and a black correction pattern 501K. The correction patterns of the respective colors, 501Y, 501M, 501C, and 501K are linear images extending in the main scanning direction. The yellow correction pattern 501Y, the magenta correction pattern 501M, the cyan correction pattern 501C and the black correction pattern 501K are formed on the intermediate transfer belt 106 in parallel in the main scanning direction and at predetermined intervals in the sub-scanning direction. A reference color for the color misregistration correction is the yellow correction pattern 501Y. The four-color correction patterns, 501Y, 501M, 501C, and 501K become a set of detection images for detecting color misregistration in the sub-scanning direction.

The color misregistration amount in the sub-scanning direction is measured as follows. Here, the color misregistration amount of magenta in the sub-scanning direction will be described. Center of gravity positions of the respective correction patterns 501Y, 501M, 501C, and 501K are detected from a detection result of the color misregistration detection sensor 400. The center of gravity positions of the respective correction patterns 501Y, 501M, 501C, and 501K when no color misregistration is caused are set to YR1, MR1, CR1, and KR1.

If the exposure position in the sub-scanning direction changes due to thermal expansion and the like of the laser scanner 200, the magenta correction pattern 501M is shifted in the sub-scanning direction and formed at a position of a correction pattern 501M'. The center of gravity position of the magenta correction pattern 501M' is shifted from the position MR1 to a position MR1'. The color misregistration amount of the magenta correction pattern 501M' in the sub-scanning direction with respect to the yellow correction pattern 501Y is expressed by a following equation.

$$\text{Color Misregistration Amount in the Sub-Scanning Direction}=(MR1'-YR1)-(MR1-YR1)=MR1'-MR1$$

The color misregistration correction in the sub-scanning direction is performed by adjusting the image-writing start timing by the laser scanner 200 using the calculated color misregistration amount in the sub-scanning direction as a correction value. The color misregistration correction of the other colors in the sub-scanning direction based on yellow is similarly performed. Here, for description, yellow is used as the reference color, although the reference color may be a different color.

FIG. 5 is an explanatory view of the color misregistration correction in the main scanning direction. The detection image for detecting color misregistration in the main scanning direction includes yellow correction patterns 521Y and 522Y, magenta correction patterns 521M and 522M, cyan correction patterns 521C and 522C, and black correction patterns 521K and 522K. The correction patterns 521Y, 521M, 521C, and 521K are linear images inclined by a predetermined angle θ with respect to the main scanning direction. The correction patterns 522Y, 522M, 522C, and 522K are linear images inclined by a predetermined angle—θ with respect to the main scanning direction. The correction patterns 521Y, 521M, 521C, and 521K and the correction patterns 522Y, 522M, 522C, and 522K are formed inclined by the same angle in a reverse direction with respect to the main scanning direction. The yellow correction pattern 521Y, the magenta correction pattern 521M, the cyan correction pattern 521C and the black correction pattern 521K are respectively formed on the intermediate transfer belt 106 in parallel and at predetermined intervals in the sub-scanning direction. The yellow correction pattern 522Y, the magenta correction pattern 522M, the cyan correction pattern 522C and the black correction pattern 522K are respectively formed on the intermediate transfer belt 106 in parallel and at predetermined intervals in the sub-scanning direction. The reference colors for the color misregistration correction are the yellow correction patterns 521Y and 522Y. The four-color correction patterns, 521Y, 522Y, 521M, 522M, 521C, 522C, 521K, and 522K become a set of detection images for detecting color misregistration in the main scanning direction.

The color misregistration amount in the main scanning direction is measured as follows. Here, the color misregistration amount of magenta in the main scanning direction is described. The color misregistration amount in the main scanning direction is also measured on the basis of the center of gravity position in the sub-scanning direction. The center of gravity positions of the respective correction patterns 521Y, 522Y, 521M, 522M, 521C, 522C, 521K, and 522K are detected from the detection result of the color misregistration detection sensor 400. The center of gravity positions of the respective correction patterns 521Y, 522Y, 521M, 522M, 521C, 522C, 521K, and 522K when no color misregistration is caused are set to YR3, YR4, MR3, MR4, CR3, CR4, KR3, and KR4.

If the exposure position in the main scanning direction changes due to the thermal expansion and the like of the laser scanner 200, the magenta correction patterns 521M and 522M are shifted in the main scanning direction and formed at positions of correction patterns 521M' and 522M'. The center of gravity positions of the magenta correction patterns 521M' and 522M' are shifted from the positions MR3 and MR4 to the positions MR3' and MR4'. A reading position of the color misregistration detection sensor 400 is expressed by a dotted line in FIG. 5. The color misregistration amounts of the magenta correction patterns 521M' and 522M' in the sub-scanning direction with respect to the yellow correction patterns 521Y and 522Y are expressed by a following equation because both are geometrically equal.

$$\text{Color misregistration amount in the sub-scanning direction}=\{(MR3'-YR3)-(MR4'-YR4)\}/2$$

The calculated color misregistration amount in the sub-scanning direction is converted to the color misregistration amount in the main scanning direction by a following equation using the angle θ by which the correction pattern inclines with respect to the main scanning direction.

$$\text{Color misregistration amount in the main scanning direction}=\{(MR3'-YR3)-(MR4'-YR4)\}/2\tan\theta$$

The color misregistration correction in the main scanning direction is performed by adjusting the image-writing start timing by the laser scanner 200 using the calculated color misregistration amount in the main scanning direction as a correction value. The color misregistration correction of the other colors in the main scanning direction based on yellow is similarly performed. Here, for description, yellow is used as the reference color, although the reference color may be a different color.

FIG. 6 is an illustration of the detection image for detecting color misregistration which is formed on the intermediate transfer belt 106 when the color misregistration correction is actually performed. The detection image for detecting color misregistration of the present embodiment consists of the detection image shown in FIG. 4 and the detection image shown in FIG. 5. In FIG. 6, six sets of detection images for detecting color misregistration in the sub-scanning direction and two sets of detection images for detecting color misregistration in the main scanning direction are combined. The combined images are formed at both ends of the intermediate transfer belt 106 in the main scanning direction. It should be noted that the number of sets of the respective detection images and an order in which the images are formed are not limited to this. Further, a shape of each correction pattern is not limited to those illustrated in FIG. 4 and FIG. 5. The shape may be a vertical line, a cross line, a triangle and the like.

Controller

Figure 7:
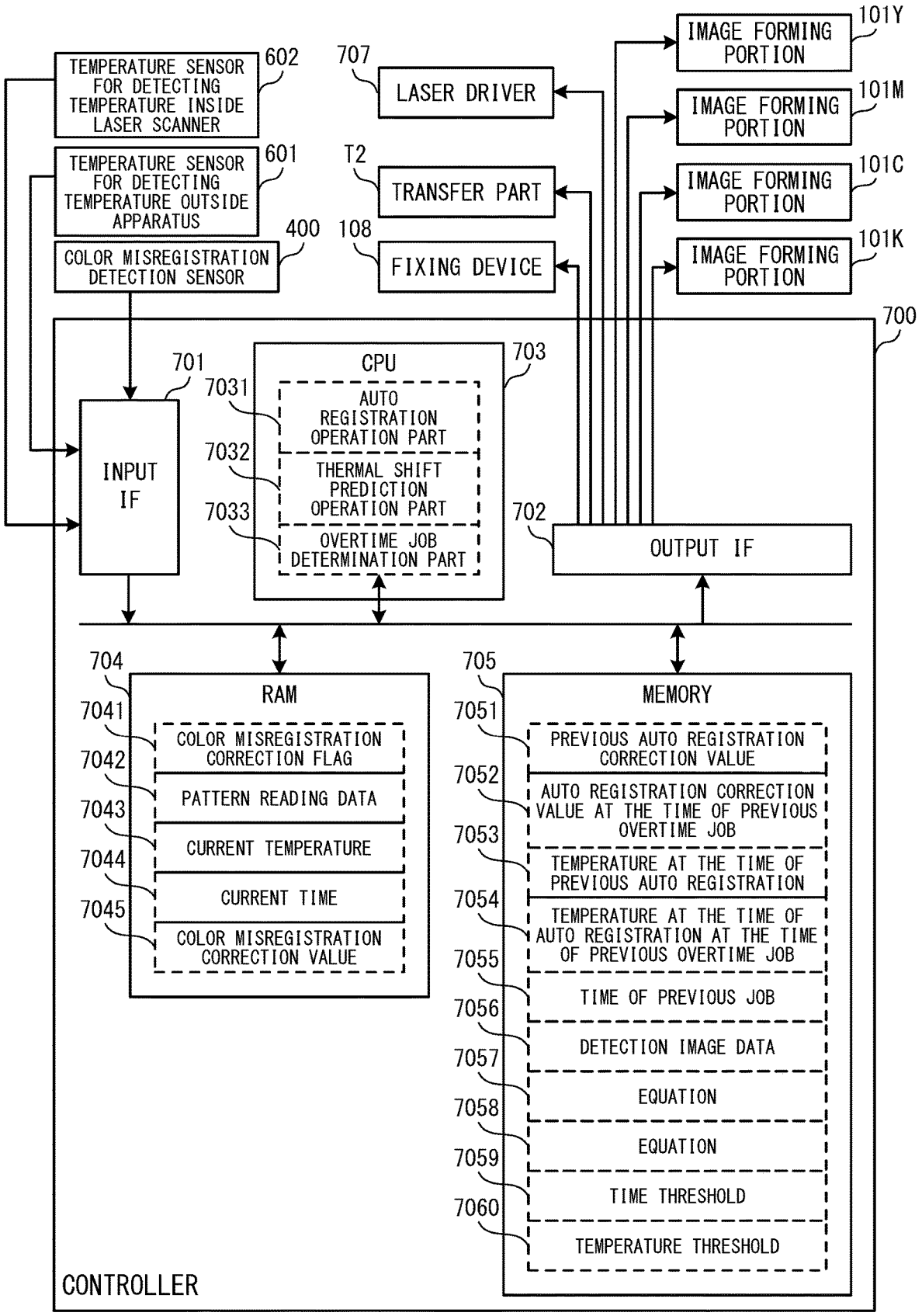
FIG. 7 is an explanatory view of a controller.

FIG. 7 is an explanatory view of a controller for controlling an operation of the image forming apparatus 100. A controller 700 includes a central processing unit (CPU) 703, a random access memory (RAM) 704, a memory 705, an input IF 701, and an output IF 702. The CPU 703 controls the entire operation of the image forming apparatus 100 by executing a computer program stored in the memory 705 by using the RAM 704 as a working area.

The input IF 701 is an input interface, to which the color misregistration detection sensor 400, the temperature sensor 601, and the temperature sensor 602 are connected. The input IF 701 obtains detection results detected by the color misregistration detection sensor 400, the temperature sensor 601, and the temperature sensor 602 and transmits the obtained results to the CPU 703. Further, an input device (not shown) is connected to the input IF 701. The input device is, for example, a touch panel and various key buttons provided in the image forming apparatus 100. The input IF 701 transmits an instruction and the like from the input device to the CPU 703.

The output IF 702 is an output interface, and transmits various control signals to the image forming portions 101Y, 101M, 101C, and 101K, a laser driver 707, the transfer part T2, and the fixing device 108 in response to the instruction of the CPU 703. The laser driver 707 controls to drive the laser scanner 200 in response to the received control signals.

As described, the RAM 704 is used as the working area. In addition to this, the RAM 704 is provided with storage areas 7041 to 7045. The storage area 7041 stores a color misregistration correction flag which indicates necessity of color misregistration correction. The CPU 703 determines the necessity of the color misregistration correction according to, for example, the detection results detected by the temperature sensor 601 and the temperature sensor 602 (temperature outside the apparatus, temperature inside the laser scanner). The storage area 7042 stores the detection result, detected by the color misregistration detection sensor 400, of the detection image formed on the intermediate transfer belt 106 (pattern reading data). The storage area 7043 stores current temperatures which are the current detection results of the temperature sensor 601 and the temperature sensor 602 (temperature outside the apparatus Tout, temperature inside the laser scanner Tscn). The storage area 7044 stores a current time t. The storage area 7045 stores a color misregistration correction value X based on the color misregistration amount detected from the pattern reading data. When performing the color misregistration correction, the image-writing start timing by the laser scanner 200 is corrected on the basis of the color misregistration correction value X.

The memory 705 consists of a nonvolatile memory, a hard disk drive (HDD) and the like. In addition to the above-described computer program, storage areas 7051 to 7060 are formed therein. The storage area 7051 stores a correction value aregX calculated at the time of the previous auto registration. The storage region 7053 stores the detection result of the temperature sensor 601 (temperature outside the apparatus aregTout) and the detection result of the temperature sensor 602 (temperature inside the laser scanner aregTscn) at the time of the previous auto registration. The storage area 7052 stores a correction value m1aregX calculated during the auto registration at the time of the previous overtime job. The storage area 7054 stores the detection result of the temperature sensor 601 (temperature outside the apparatus m1aregTout) if the auto registration is performed before the image is formed on the basis of the previous overtime job. Further, the storage area 7054 stores the detection result of the temperature sensor 602 (temperature inside the laser scanner m1aregTscn) if the auto registration is performed before the image is formed on the basis of the previous overtime job. The "overtime job" will be described later.

The storage area 7055 stores a time prevt at which the previous job is finished. The storage area 7056 stores the image data of the detection image which is formed on the intermediate transfer belt 106 during the auto registration. The storage areas 7057 and 7058 store two prediction equations of thermal shift. The storage area 7059 stores time threshold tth. The storage area 7060 stores temperature threshold Tth1 and temperature threshold Tth2.

The CPU 703 includes an auto registration operation part 7031, a thermal shift prediction operation part 7032, and an overtime job determination part 7033. The CPU 703 forms the detection image for detecting color misregistration on the intermediate transfer belt 106 by the image forming portions 101Y to 101K. The CPU 703 obtains the detection result, detected by the color misregistration detection sensor 400, of the detection image formed on the intermediate transfer belt 106 (pattern reading data). The CPU 703 obtains the color misregistration correction value X from the color misregistration amount (color misregistration amount data) which is calculated from the detection result.

The CPU 703 calculates the color misregistration correction value X by the auto registration operation part 7031, the thermal shift prediction operation part 7032, and the overtime job determination part 7033. At this time, the CPU 703 predicts the color misregistration amount on the basis of the detection result of the temperature sensor 601 (temperature outside the apparatus) and the detection result of the temperature sensor 602 (temperature inside the laser scanner). In the image formation thereafter, the CPU 703 reduces the color misregistration by correcting the image-writing start timing by the laser scanner 200 according to the correction value X.

The auto registration operation part 7031 calculates the color misregistration amount on the basis of the detection result, detected by the color misregistration detection sensor 400, of the detection image formed on the intermediate transfer belt 106 (pattern reading data). Details of the processing of the thermal shift prediction operation part 7032 and the overtime job determination part 7033 will be described later.

Figure 8:
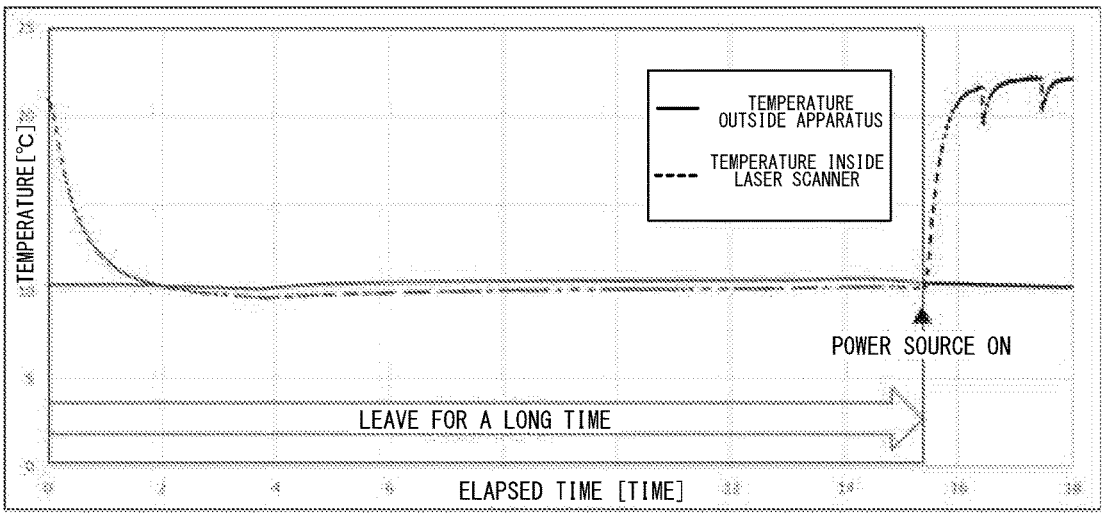
FIG. 8 is a graph showing changes of temperature inside the laser scanner and a temperature outside the apparatus over time.

FIG. 8 is a graph showing changes over time of the temperature inside the laser scanner and the temperature outside the apparatus. This graph shows changes over time of each temperature from a previous day when the image forming apparatus 100 is left unoperated to a next morning. When about 6 hours pass after starting to leave the image forming apparatus 100, the temperature inside the laser scanner becomes almost the same temperature as the temperature outside the apparatus. The image forming apparatus 100 performs a job immediately after the power source is turned on at a time point at which the temperature starts to rise. The image forming apparatus 100 performs the other jobs in a transitional period during which the temperature increases. Thus, an internal state of a deformation model of the laser scanner 200 at a time point when performing the respective jobs is different.

Figure 9:
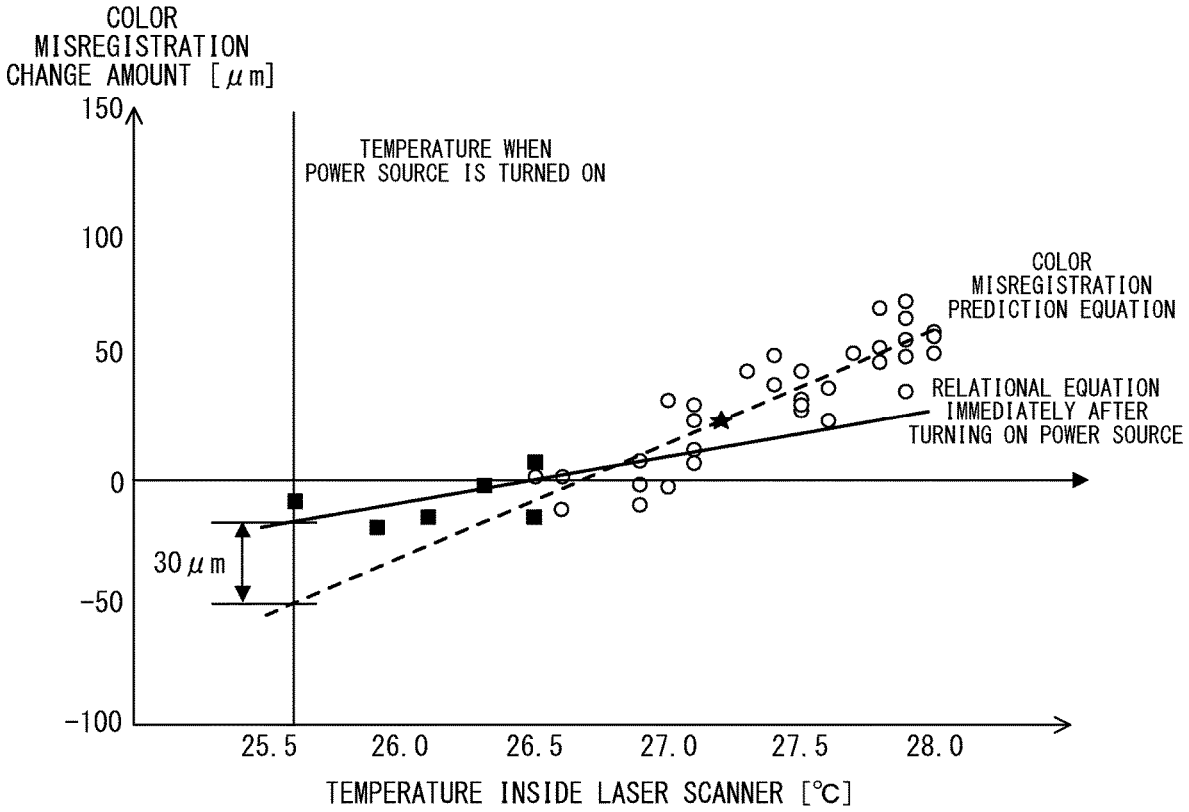
FIG. 9 is a graph showing relation between the temperature inside the laser scanner and a color misregistration amount.

The difference in the internal state also appears in relation between the actual temperature and the color misregistration. FIG. 9 is a graph showing relation between the temperature inside the laser scanner and the color misregistration amount. This graph shows the relation after turning on the power source of the image forming apparatus 100 after leaving the image forming apparatus 100 for about 15 hours at a constant temperature after the use of the image forming apparatus 100. In FIG. 9, a square represents the relation between the temperature inside the laser scanner immediately after turning on the power source and the color misregistration amount. A circle represents the relation between the temperature inside the laser scanner when performing the job and the color misregistration amount. Relational equation between the temperature inside the laser scanner and the color misregistration amount immediately after turning on the power source is different from that when performing the job.

For example, when the temperature inside the laser scanner transfers to the temperature inside the laser scanner at turning on the power source after the image forming apparatus 100 is left unoperated for a long time after the auto registration is performed at a point of asterisk, if the color misregistration prediction is performed by the prediction equation shown by a broken line, color misregistration prediction residual of about 30 micrometers is generated. The color misregistration prediction residual increases as the temperature difference increases. Thus, it is general to reduce the color misregistration by performing the auto registration in pre-operation after the power source is turned on. It should be noted that the image forming apparatus performs the image formation on the sheet after the pre-operation is completed. It should be noted that the "pre-operation" is an initial operation required for performing the image formation.

As described, if the prediction equation of the color misregistration used in the job at another point of time is similarly used in the job after leaving the image forming apparatus 100 unoperated for a long time, prediction error according to the difference of the internal state is generated. To avoid this, if the auto registration is performed in the pre-operation of the job immediately after leaving the image forming apparatus 100 for a long time, downtime increases. The image forming apparatus 100 according to the present embodiment performs the color misregistration correction (auto registration) while suppressing the occurrence of the downtime. Embodiments will be described in the following.

First Embodiment

Figure 10:
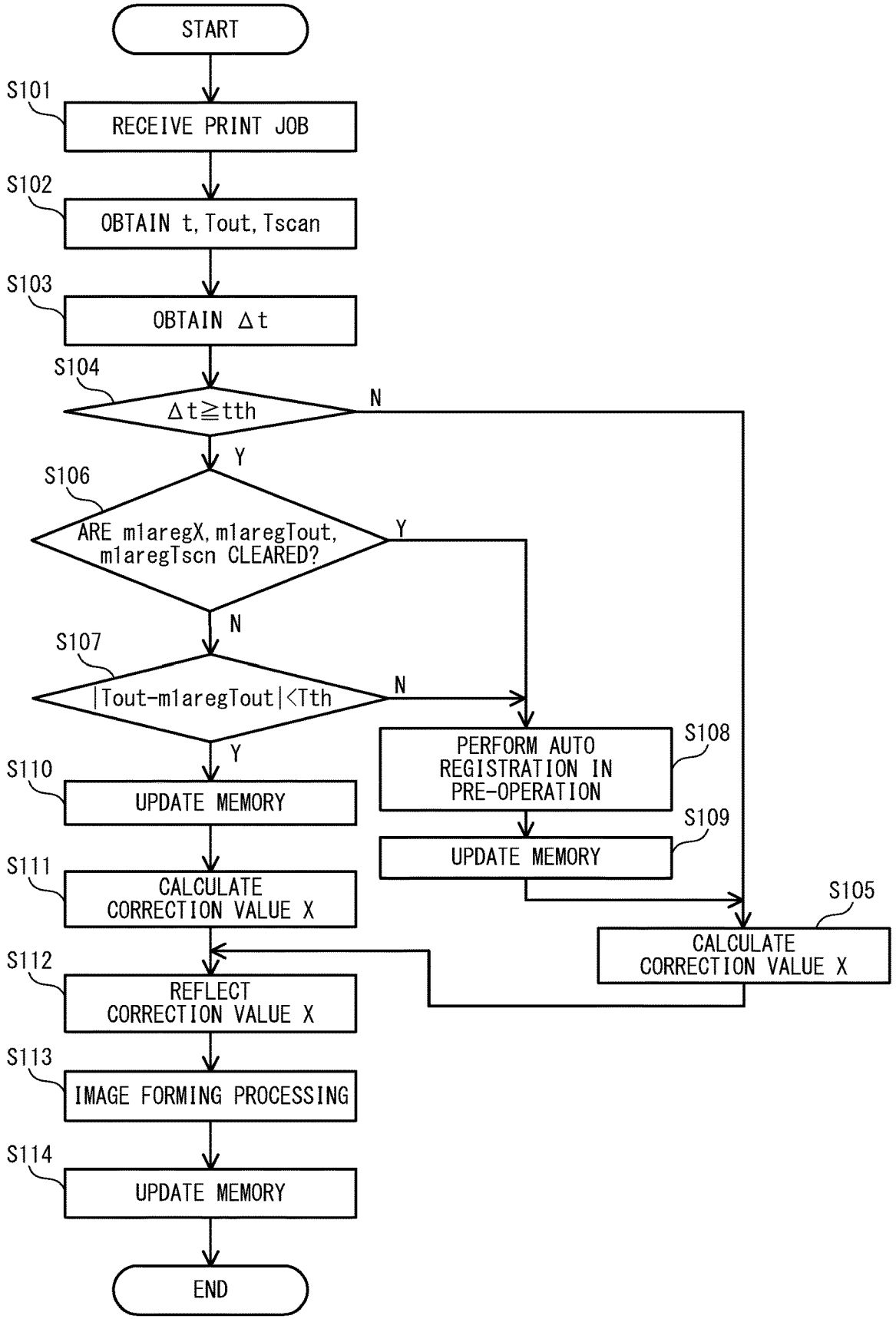
FIG. 10 is a flowchart showing processing from a start of a job to a calculation of a correction value.

FIG. 10 is a flow chart showing processing from a start of a job to a calculation of a correction value. In the following description, "overtime job" is a job which is performed after an elapsed time Δt since the previous job is finished has elapsed predetermined time threshold tth or more. A "normal job" is a job other than the overtime job. "Tout" represents the detection result of the current temperature sensor 601 (temperature outside the apparatus). "Tscn" represents the detection result of the current temperature sensor 602 (temperature inside the laser scanner). "X" represents the color misregistration correction value. A suffix attached to a left side of each symbol represents a value stored in the memory 705. "areg" represents a value stored at the time of the previous auto registration. "m1areg" represents a value stored at the time of the auto registration during the previous overtime job. For example, m1aregTout represents the detection result of the temperature sensor 601 (temperature outside the apparatus) when the auto registration is performed before the image is formed on the basis of the previous overtime job. The temperature outside the apparatus m1aregTout is stored in the memory 705.

When receiving the print job (Step S101), the CPU 703 obtains the current time t, the temperature outside the apparatus Tout which is the detection result of the temperature sensor 601, and the temperature inside the laser scanner Tscn which is the detection result of the temperature sensor 602 (Step S102). The CPU 703 obtains the elapsed time Δt since the previous job is finished from the current time t and the time prevt at which the previous job is finished (Step S103). The CPU 703 determines whether the elapsed time Δt is the time threshold tth or more or not (Step S104). It means that the CPU 703 determines whether the elapsed time from the previous image formation is a predetermined time or longer or not.

If it is determined that the elapsed time Δt is less than the time threshold tth (Step S104: N), that is, if the elapsed time from the previous image formation is less than a predetermined time, the CPU 703 processes the received job as the normal job. In this case, the CPU 703 calculates the correction value X by the normal job (Step S105). In the normal job, the CPU 703 calculates the correction value X from the current temperature inside the laser scanner Tscn, the temperature inside the laser scanner aregTscn at the time of the previous auto registration, and the correction value aregX at the time of the previous auto registration using a following equation (1). α2 is a predetermined coefficient. The equation (1) is a prediction equation of the thermal shift. The correction value X calculated here is a predicted value.

$$X=\alpha 2\times(Tscn-aregTscn)+aregX \qquad \text{Equation (1)}$$

If it is determined that the elapsed time Δt is the time threshold tth or more (Step S104: Y), that is, if the elapsed time from the previous image formation is a predetermined time or longer, the CPU 703 processes the received job as the overtime job. In this case, the CPU 703 determines whether the correction value m1aregX, the temperature outside the apparatus m1aregTout, and the temperature inside the laser scanner m1aregTscn in the memory 705 are cleared or not (Step S106). In the processing of the step S106, the CPU 703 determines that the correction value m1aregX, the temperature outside the apparatus m1aregTout, and the temperature inside the laser scanner m1aregTscn are cleared if the correction value is an initial value and the temperature is an initial temperature. If it is determined that the correction value m1aregX, the temperature outside the apparatus m1aregTout, and the temperature inside the laser scanner m1aregTscn are not cleared (Step S106: N), the CPU 703 determines whether or not an absolute value of a temperature difference between the current temperature outside the apparatus Tout and the temperature outside the apparatus m1aregTout when performing the auto registration in the previous overtime job is smaller than the temperature threshold value Tth (Step S107). The CPU 703 determines whether a temperature difference between the temperature outside the apparatus Tout detected before the image forming operation after the image forming apparatus 100 is left unoperated for a predetermined time or longer this time and the temperature outside the apparatus m1aregTout detected before the image forming operation after the image forming apparatus 100 is left unoperated for a predetermined time or longer previously is less than a predetermined temperature or not. It means that the CPU 703 determines whether or not the detected temperature at the time of the pre-operation this time is changed by a predetermined temperature or more from the detected temperature at the time of the previous pre-operation.

On the other hand, if it is determined that the correction value m1aregX, the temperature outside the apparatus m1aregTout, and the temperature inside the laser scanner m1aregTscn are cleared (Step S106: Y), the CPU 703 performs the auto registration in the pre-operation (Step S108). Moreover, if the absolute value of the temperature difference between the temperature outside the apparatus Tout and the temperature outside the apparatus m1aregTout is the temperature threshold Tth or more (Step S107: N), the CPU 703 performs the auto registration in the pre-operation (Step S108). It means that the CPU 703 also performs the auto registration in the pre-operation even in a case where the temperature difference between the temperature outside the apparatus Tout and the temperature outside the apparatus m1aregTout is a predetermined temperature or more. This is because it is likely that the current color misregistration is different from the color misregistration in the previous pre-operation. The CPU 703 updates a value to be stored in the memory 705 to a value calculated by a following equation (2) when performing the auto registration.

aregX=X0 aregTout=Tout aregTscn=Tscn Equation (2)

X0 is an initial value of the correction value, which is a predetermined value.

The CPU 703 updates a value to be stored in the memory 705 to a value calculated by a following equation (3) by performing the auto registration during the overtime job (Step S109). After updating the value, the CPU 703 calculates the correction value X by the normal job (Step S105).

m1aregX=aregX m1aregTout=aregTout m1aregTscn=aregTscn Equation (3)

Here, it is when it is necessary to obtain a new color misregistration correction value that the respective values of the correction value m1aregX, the temperature outside the apparatus m1aregTout and the temperature inside the laser scanner m1aregTscn are cleared. It is when components relating to the image formation such as the laser scanner 200, the photosensitive drums 102Y to 102K, and the intermediate transfer belt 106 are replaced, when the image forming apparatus 100 is installed, and when the auto registration is performed by the instruction from the input device that the new color misregistration value needs to be obtained.

Moreover, if it is determined that the absolute value of the temperature difference between the temperature outside the apparatus Tout and the temperature outside the apparatus m1aregTout is less than the temperature threshold value Tth (Step S107: Y), the CPU 703 updates a value to be stored in the memory 705 to a value calculated by a following equation (4) when performing the auto registration (Step S110).

aregX=m1aregX aregTout=m1aregTout aregTscn=m1aregTscn Equation (4)

The CPU 703 calculates the correction value X using a following equation (5) (Step S111). In the overtime job, the CPU 703 calculates the correction value X from the current temperature inside the laser scanner Tscn, the temperature inside the laser scanner m1aregTscn at the time of the auto registration during the previous overtime job, and the correction value m1aregX at the time of the auto registration during the previous overtime job. α1 is a predetermined coefficient. The equation (5) is a prediction equation of the thermal shift. The correction value X to be calculated here is a predicted value.

$$X=\alpha 1\times(Tscn-m1aregTscn)+m1aregX \quad \text{Equation (5)}$$

As described above, the color misregistration correction value X is calculated by either the normal job or the overtime job. The CPU 703 reflects the calculated correction value X to correct the respective control timing and performs the image forming processing according to the print job (Step S112, Step S113). After the image formation, the CPU 703 calculates the time prevt at which the previous job is finished using a following equation (6), and updates the value in the memory 705 (Step S114).

prevt=t Equation (6)

In the above processing, the coefficient α2 used in the equation (1) and the coefficient α1 used in the equation (5) are coefficients of the prediction equation of the thermal shift, which are experimentally derived. Moreover, the image forming apparatus 100 according to the present embodiment is so configured that the temperature sensor 601 detects the temperature outside the apparatus Tout, but the temperature sensor 601 may detect a temperature outside the laser scanner 200 (temperature outside the laser scanner). In this case, a term of the temperature outside the apparatus used in the prediction equation may be replaced by the temperature outside the laser scanner. In addition, the CPU 703 may determine whether to perform the auto registration or not on the basis of a comparison result of the current temperature outside the laser scanner and a reference temperature of the temperature outside the laser scanner stored in the memory 705. In addition, the detection temperature used for the prediction and determination of the job is not limited to the temperature outside the apparatus but may be used in combination with the temperature of the substrate of the laser scanner 200 and the like. For example, in the processing of the step S107, instead of using the temperature outside the apparatus Tout and the temperature outside the apparatus m1aregTout, the current temperature inside the laser scanner Tscn and the temperature inside the laser scanner m1aregTscn at the time of the auto registration during the previous overtime job may be used. Further, if the processing is started in a state in which the temperature outside the apparatus aregTout, the temperature inside the laser scanner aregTscn, and the correction value m1aregX at the time of the previous auto registration are not stored in the memory 705, the CPU 703 performs the auto registration in the pre-operation of the job.

As described above, the color misregistration correction value X is calculated by applying the prediction equation dedicated to predict the color misregistration amount to a job such as the overtime job immediately after leaving the image forming apparatus 100 for a long time, in which the relational equation between the color misregistration amount and the temperature of the overtime job is different from that at performing timing of the other jobs. By calculating the correction value X in this manner, frequency to perform the auto registration in the pre-operation can be reduced without deteriorating the color misregistration.

Figure 11:
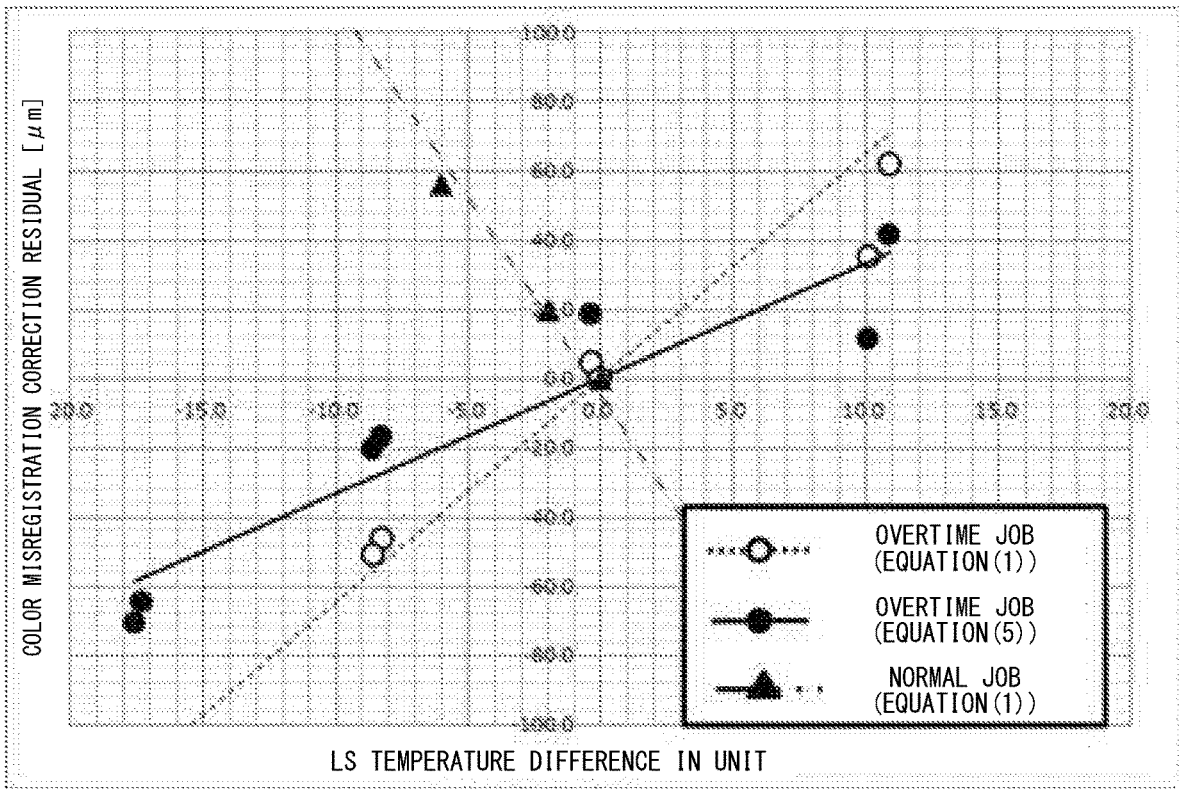
FIG. 11 is a diagram showing relation between a correction residual and a temperature.

FIG. 11 shows relation between the correction residual and the temperature when performing the auto registration. Here, a case of performing three types of color misregistration corrections, in particular, performing the correction of the equation (1) for the normal job, performing the correction of the equation (1) for the overtime job, and performing the correction of the equation (5) for the overtime job, will be described. FIG. 11 shows that, regardless of a type of prediction equation, correction accuracy is significantly improved by performing the correction by the overtime job compared with the case of performing the correction by the normal job.

Moreover, even by the same overtime job, the correction using the equation (5) reduces an inclination of the relational equation between the correction residual and the temperature to approximately half with respect to the correction using equation (1). Thus, a temperature range which needs no auto registration in the pre-operation is doubled with respect to color misregistration tolerance. For example, if the color misregistration allowable range is 20 μm, by the correction using the equation (1), the temperature threshold Tth is approximately equal to 3° C. (temperature threshold Tth≈3° C.), whereas by the correction using the equation (5), the temperature threshold Tth is approximately equal to 6° C. (temperature threshold value Tth≈6° C.).

As described above, the image forming apparatus 100 of the present embodiment is capable of reducing the downtime due to the auto registration in the pre-operation while maintaining the performance of the color misregistration correction after leaving the image forming apparatus 100 for a long time by switching to perform the two correction patterns of the overtime job and the normal job. Further, by separately using the prediction equation for predicting the color misregistration amount in the overtime job and the normal job, it is possible to accurately perform the color misregistration correction.

Second Embodiment

Figure 12:
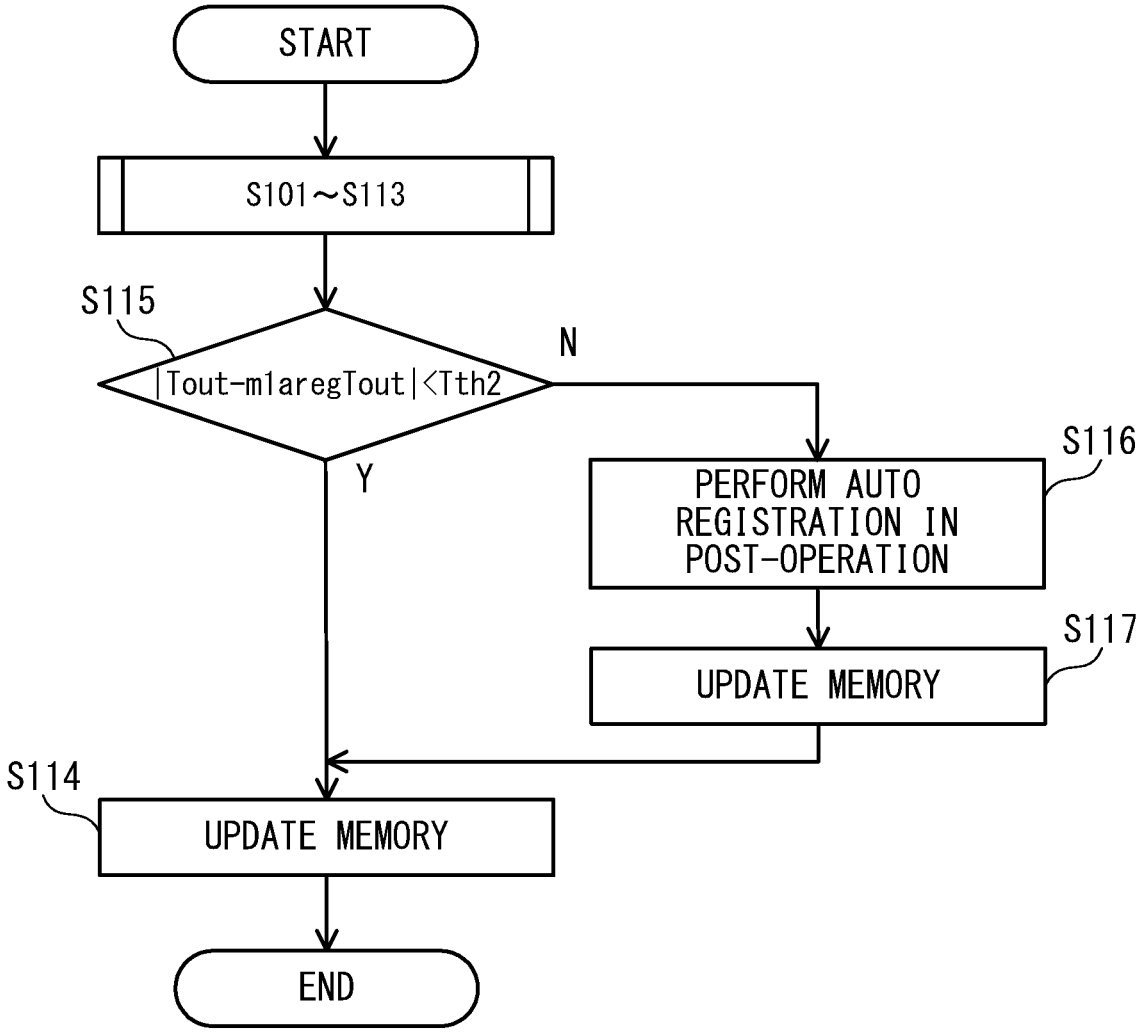
FIG. 12 is a flowchart showing processing from a start of a job to a calculation of a correction value.

FIG. 12 is a flow chart showing processing from a start of a job to a calculation of a correction value according to a second embodiment. The processing from the step S101 to the step S113 is the same processing as the processing of the first embodiment shown in FIG. 10. In the second embodiment, after the image forming processing of the step S113, the CPU 703 determines whether the absolute value of the temperature difference between the current temperature outside the apparatus Tout and the temperature outside the apparatus m1aregTout is smaller than the temperature threshold Tth2 or not (Step S115). The temperature threshold value Tth2 is set to a value smaller than the temperature threshold Tth.

If it is determined that the absolute value of the temperature difference between the current temperature outside the apparatus Tout and the temperature outside the apparatus m1aregTout is smaller than the temperature threshold Tth2 (Step S115: Y), the CPU 703 performs the processing of the step S114. If it is determined that the absolute value of the temperature difference between the current temperature outside the apparatus Tout and the temperature outside the apparatus m1aregTout is the temperature threshold Tth2 or more (Step S115: N), the CPU 703 performs the auto registration in a post-operation after the print job is performed (Step S116). The "post-processing" is a preliminary operation required to finish the image formation. The CPU 703 updates a value to be stored in the memory 705 to a value calculated by the equation (2) when performing the auto registration. Thereafter, the CPU 703 updates a value to be stored in the memory 705 to a value calculated by the equation (3) (Step S117) and performs the processing of the step S114.

If a result of the auto registration performed in the post-processing is used to calculate the color misregistration correction value, an influence of the temperature rise due to the image formation can be considered. However, in general, as the number of sheets on which the image formation is performed at one time is small, the rise in the temperature inside the apparatus by the overtime job is negligible, which gives little influence on the calculation of the correction value. Similar to the first embodiment, the detection temperature used for the prediction and the determination of the job is not limited to the temperature outside the apparatus, but may also be used in combination with the temperature of the substrate of the laser scanner 200 and the like. For example, in the processing in the step S115, instead of using the temperature outside the apparatus Tout and the temperature outside the apparatus m1aregTout, the current temperature inside the laser scanner Tscn and the temperature inside the laser scanner m1aregTscn when performing the auto registration during the previous overtime job may be used.

In the second embodiment as described, it is possible to update the value in the memory 705 at the time of the overtime job while suppressing the increase in the downtime so that the number of times to perform the auto registration in the pre-operation by the processing of the step S108 can be reduced. As a result, further reduction of the downtime can be realized.

Third Embodiment

Even in the case of the overtime job, there is a case where the internal state of the image forming apparatus 100 is not similar to the internal state of the image forming apparatus 100 at the time of the previous overtime job. For example, in an environment in which the temperature outside the apparatus greatly differs depending on a day such as at the time of a change of season or an environment in which the temperature outside the apparatus is not stable due to air conditioning control and the like, the temperature outside the apparatus at the time of the daily overtime job is unstable. Since the temperature outside the apparatus is unstable, the temperature inside the apparatus is unstable. This is why the internal state of the image forming apparatus 100 is not similar to the internal state at the time of the previous overtime job. If the color misregistration correction is performed on the basis of the value stored in the memory 705 at the time of the daily overtime job, an erroneous correction may possibly be performed. Thereby, the image forming apparatus 100 which is installed in an environment in which the temperature outside the apparatus greatly varies at the time of the daily overtime job is configured not to perform the color misregistration correction on the basis of the value stored in the memory 705 at the time of the overtime job.

Figure 13:
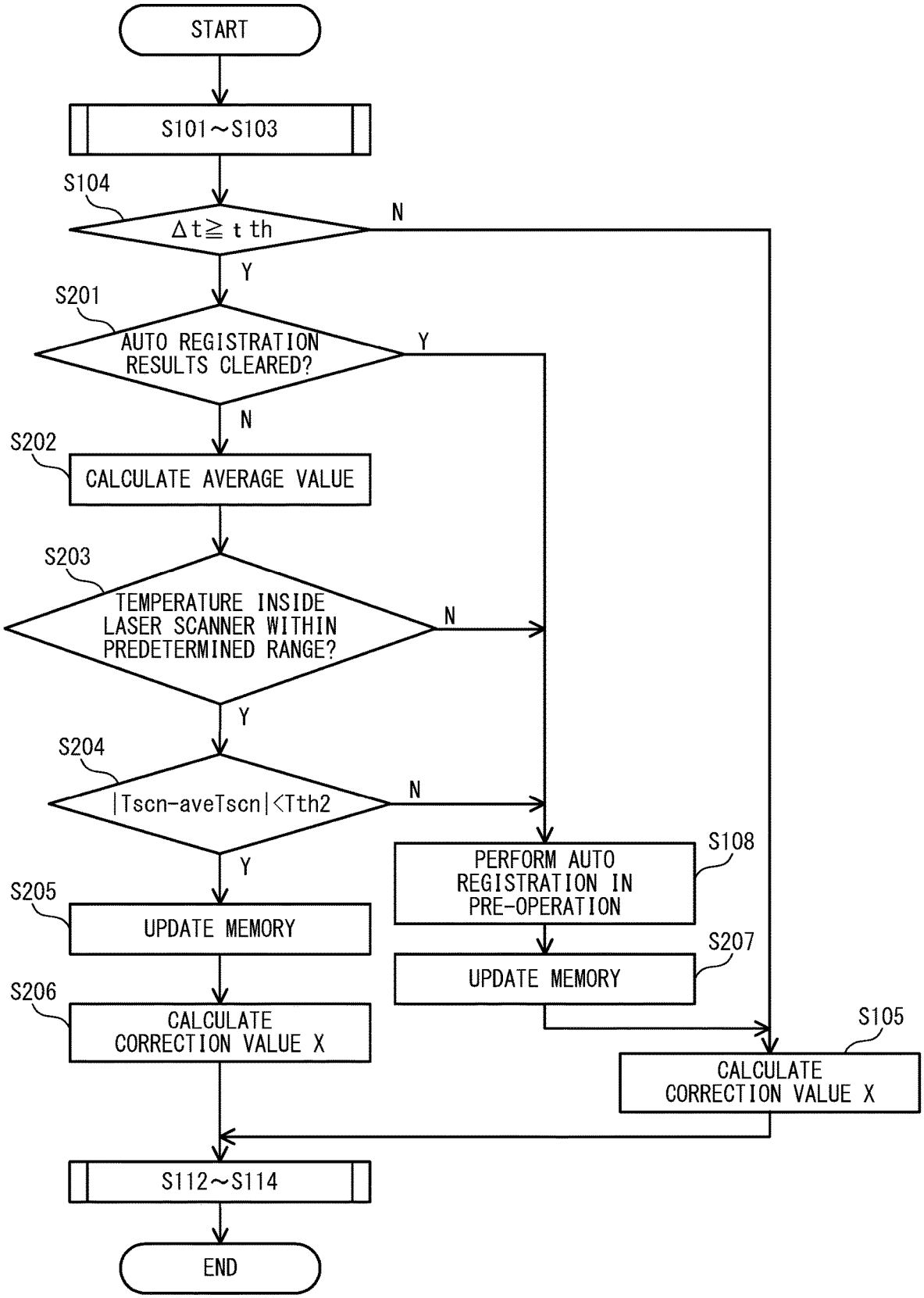
FIG. 13 is a flowchart showing processing from a start of a job to a calculation of a correction value.

FIG. 13 is a flow chart showing processing from a start of a job to a calculation of a correction value according to a third embodiment. The processing in the step S101 to the step S104 is the same processing as the first embodiment shown in FIG. 10. In the following description, a suffix attached to a left side of each symbol represents a value stored in the memory 705. "m1areg" represents a value stored at the time of the auto registration during the previous overtime job. The number included in "m1areg" indicates that it is a value at the time of the auto registration earlier than that number. For example, m1aregTout represents the detection result of the temperature sensor 601 (temperature outside the apparatus) stored one time before, that is, at the time of the auto registration during the previous overtime job. "ave" represents an average value of the values stored at the time of the auto registration during the overtime jobs for the past several times. It should be noted that, in this embodiment, the average value of the values for the past three times is described as an example, but it is not limited to the past three times as long as it is multiple times.

If it is determined that the elapsed time Δt is less than the time threshold tth in the step S104 (Step S104: N), the CPU 703 performs the processing as the normal job and performs the processing of the step S105. If it is determined that the elapsed time Δt is the time threshold tth or more in the processing of the step S104 (Step S104: Y), the CPU 703 performs the processing of the overtime job. The CPU 703 determines whether the results of the auto registration at the time of the overtime job for the past few times (in the present embodiment, three times) stored in the memory 705 are cleared or not (Step S201).

If it is determined that the results are not cleared (Step S201: Y), the CPU 703 calculates the average value of the values of the results of the auto registration at the time of the overtime job for the past three times (Step S202). The CPU 703 calculates an average value aveTout of the temperatures outside the apparatus m1aregTout, m2aregTout and m3aregTout. The CPU 703 calculates an average value aveTscn of the temperatures inside the laser scanner m1aregTscn, m2aregTscn and m3aregTscn. The CPU 703 calculates an average value aveX of the correction values m1aregX, m2aregX and m3aregX.

The CPU 703 determines whether variation in the temperatures inside the laser scanner for the past three times, m1aregTscn, m2aregTscn and m3aregTscn, is within a predetermined range or not (Step S203). Here, the CPU 703 determines whether the temperature difference between each of the temperatures inside the laser scanner for the past three times, m1aregTscn, m2aregTscn and m3aregTscn and the average value aveTout is smaller than the temperature threshold Tth1 or not. It means that the CPU 703 determines whether the temperature difference between a plurality of temperatures inside the laser scanner and their average value is less than a predetermined temperature or not. If it is determined that the temperature difference is smaller than the temperature threshold Tth1, the CPU 703 determines that the variation in the temperatures inside the laser scanner m1aregTscn, m2aregTscn, and m3aregTscn is within a predetermined range (less than a predetermined temperature) (Step S203: Y). In this case, the CPU 703 determines whether the absolute value of the temperature difference between the average value aveTout of the temperatures inside the laser scanner and the current temperature inside the laser scanner Tscn is smaller than the temperature threshold value Tth2 or not (Step S204).

If it is determined that the results of the auto registration in the memory 705 are cleared (Step S201: Y), the CPU 703 performs the processing of the step S108. The CPU 703 also performs the processing of the step S108 even in a case where the variation in the temperature inside the laser scanner is not within a predetermined range (Step S203: N), that is, in a case where the temperature difference is a predetermined temperature or more. Moreover, the CPU 703 also performs the processing of the step S108 if the absolute value of the temperature difference between the average value aveTout and the temperature inside the laser scanner Tscn is the temperature threshold Tth2 or more (Step S204: N). After the processing of the step S108, the CPU 703 updates a value to be stored in the memory 705 to a value to be calculated by a following equation (6) when performing the auto registration in the overtime job (Step S207). The CPU 703 discards the results of the auto registration prior to the past three times when updating the value in the memory 705. Thereafter, the CPU 703 performs the processing of the step S105.

m1aregX=aregX m1aregTout=aregTout m1aregTscn=aregTscn m2aregX=m1aregX m2aregTout=m1aregTout m2aregTscn=m1aregTscn m3aregX=m2aregX m3aregTout=m2aregTout m3aregTscn=m2aregTscn Equation (6)

Here, it is when it is necessary to obtain a new color misregistration correction value that the respective values of the correction values, the temperatures outside the apparatus and the temperatures inside the laser scanner for the past three times are cleared. It is when the components relating to the image formation such as the laser scanner 200, the photosensitive drums 102Y to 102K, the intermediate transfer belt 106 and the like are replaced, when the image forming apparatus 100 is installed, and when the auto registration is performed by the instruction from the input device that the new color misregistration correction value needs to be obtained.

If it is determined that the absolute value of the temperature difference between the average value aveTout and the temperature inside the laser scanner Tscn is less than the temperature threshold Tth2 (Step S204: N), the CPU 703 updates a value to be stored in the memory 705 to a value calculated by a following equation (7) when performing the auto registration (Step S205).

aregX=aveX aregTout=aveTout aregTscn=aveTscn Equation (7)

The CPU 703 calculates the correction value X from the current temperature inside the laser scanner Tscn, the average value aveTscn of the temperatures inside the laser scanner, and the average value aveX of the correction values using an equation (8) (Step S206). The equation (8) is a prediction equation of the thermal shift. The correction value X calculated here is a predicted value. Thereafter, the CPU 703 performs the same processing as the steps S112 to S114 of the first embodiment shown in FIG. 10 and finishes the processing.

$$X=\alpha 1(Tscn-aveTscn)+aveX \quad \text{Equation (8)}$$

Figure 14:
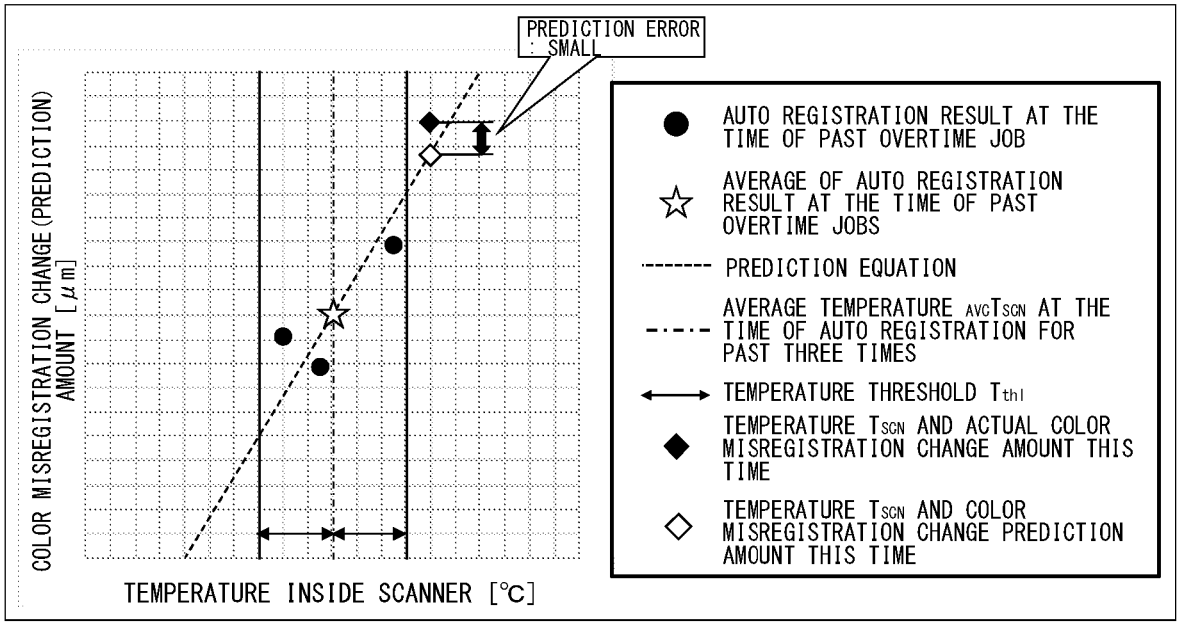
FIG. 14 is a diagram explaining color misregistration prediction propriety determination of an overtime job.
Figure 15:
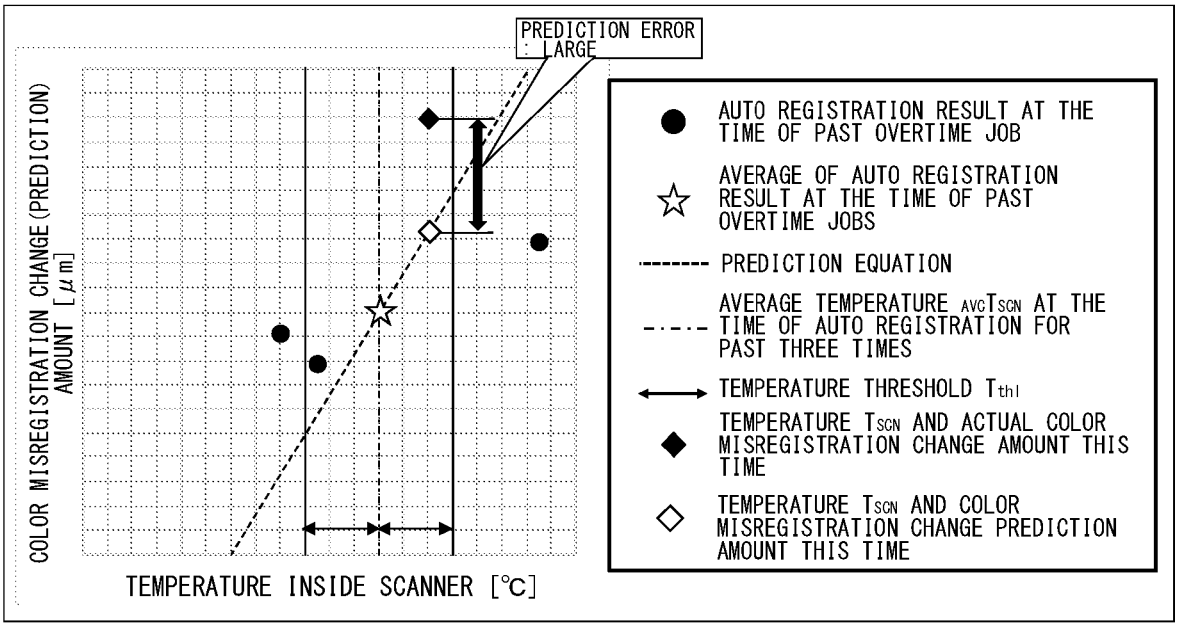
FIG. 15 is a diagram explaining color misregistration prediction propriety determination of an overtime job.

FIG. 14 and FIG. 15 are diagrams each explaining color misregistration prediction propriety determination of the overtime job. The color misregistration prediction propriety determination of the overtime job is performed by determining whether the variation in the temperatures inside the laser scanner m1aregTscn, m2 aregTscn and m3aregTscn of the processing of the step S203 is within a predetermined range or not.

FIG. 14 and FIG. 15 show relation between the temperature inside the laser scanner and a color misregistration change (prediction) amount in the overtime job or in the result of the auto registration performed in the overtime job. In performing the color misregistration correction, the image-writing start timing by the laser scanner 200 is adjusted according to the color misregistration change prediction amount. In FIG. 14 and FIG. 15, a circle represents relation between the temperatures inside the laser scanner m1aregTscn, m2aregTscn, and m3aregTscn and the color misregistration change amount at the time of the auto registration performed in the overtime job for the past three times. An asterisk represents relation between the average value aveTscn and the average value aveX. aveTscn represents the average value of the temperatures inside the laser scanner m1aregTscn, m2aregTscn, and m3aregTscn. aveX represents the average value of the color misregistration change amounts. Inside of a solid line frame represents an area where the difference between the temperature inside laser scanner of the past and its average value aveTscn is within the temperature threshold Tth1. A black diamond represents relation between the temperature inside the laser scanner Tscn and the actual color misregistration change amount in the overtime job this time. A white diamond represents relation between the temperature inside the laser scanner Tscn and the color misregistration change prediction amount X this time. This is predicted on the basis of the average value aveTscn of the temperatures inside the laser scanner and the average value aveX of the color misregistration change amounts using the temperature inside the laser scanner Tscn and the prediction equation in the overtime job this time.

In FIG. 14, the temperatures inside the laser scanner m1aregTscn, m2aregTscn, and m3aregTscn which are the results of the auto registration at the time of the overtime job for the past three times fall in the region in the solid line frame. In this case, it is considered that the internal state at the time of the overtime job for the past three times is stable and similar. Therefore, the CPU 703 determines that it is possible to predict the color misregistration amount. In FIG. 15, the temperatures inside the laser scanner m1aregTscn, m2 aregTscn, and m3 aregTscn which are the results of the auto registration at the time of the overtime job for the past three times do not fall in the region in the solid line frame. In this case, it is considered that the internal state at the time of the overtime job for the past three times is different. Therefore, the CPU 703 determines that the color misregistration amount prediction error may become large so that the CPU 703 performs the auto registration in the pre-operation.

It should be noted that the temperature used for the prediction and the determination of the job is not limited to the temperature inside the laser scanner, but may also be used in combination with the temperature outside the apparatus, the temperature of the substrate of the laser scanner 200 and the like. For example, in the processing of the step S204, instead of using the temperature inside the laser scanner Tscn and the average value aveTscn, the current temperature outside the apparatus Tout and the average value aveTout of the temperatures outside the apparatus may be used. The temperature outside the apparatus Tout and the temperature near the outside the apparatus such as the temperature on the substrate of the laser scanner 200 have good responsiveness to the change of the temperature outside the apparatus so that, by using the temperature to determine the job, it is possible to determine with high accuracy that the internal state is not similar.

Fourth Embodiment

Figure 16:
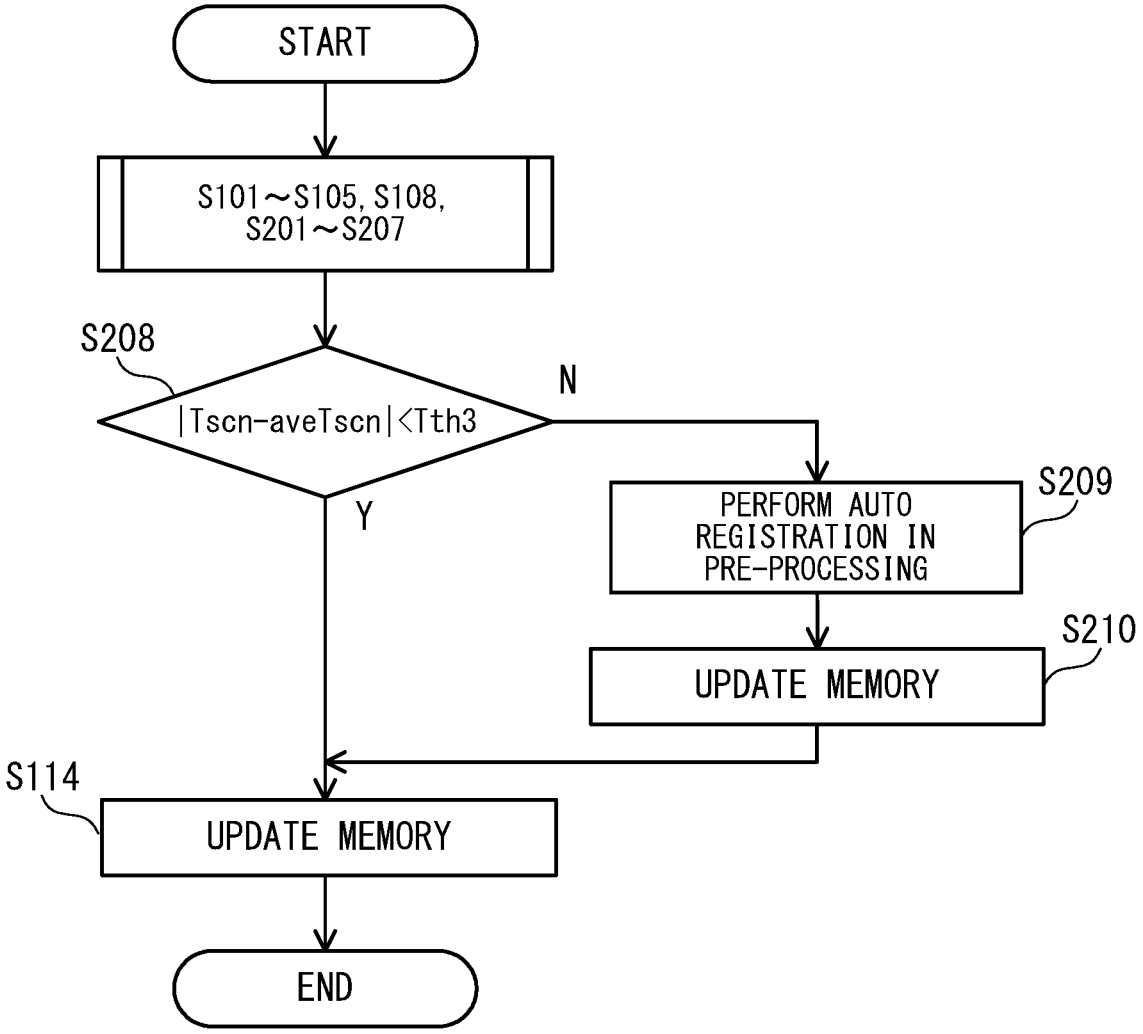
FIG. 16 is a flowchart showing processing from a start of a job to a calculation of a correction value.

FIG. 16 is a flow chart showing processing from a start of a job to a calculation of a correction value according to a fourth embodiment. The processing of the steps S101 to S105, S108, S201 to S207 is the same processing as the processing of the third embodiment shown in FIG. 13. In the fourth embodiment, after the image forming processing of the step S113, the CPU 703 determines whether the absolute value of the temperature difference between the temperature inside the laser scanner Tscn and the average value aveTscn of the temperatures inside the laser scanner is smaller than temperature threshold Tth3 or not (Step S208). The temperature threshold Tth3 is set to a value smaller than the temperature threshold Tth2 and stored in the storage region 7060 of the memory 705.

If it is determined that the absolute value of the temperature difference between the temperatures inside the laser scanner is smaller than the temperature threshold Tth3 (Step S208: Y), the CPU 703 performs the processing of the step S114. If it is determined that the absolute value of the temperature difference between the temperatures inside the laser scanner is the temperature threshold Tth3 or more (Step S208: N), the CPU 703 performs the auto registration in the post-operation of the print job by the same processing as the processing of the step S116 of the first embodiment (Step S209). Thereafter, the CPU 703 updates a value to be stored in the memory 705 to a value calculated by the equation (6) and performs the processing of the step S114.

If the result of the auto registration performed in the post-operation is used to calculate the color misregistration correction value, an influence of the temperature rise due to the image formation may be considered. However, as the number of sheets on which the image formation is performed at one time is generally small, the rise in the temperature inside the apparatus by the overtime job is negligible, which gives little influence on the calculation of the correction value. Similar to the third embodiment, the detection temperature used for the prediction and the determination of the job is not limited to the temperature inside the laser scanner, but may also be used in combination with the temperature outside the apparatus, the temperature of the substrate of the laser scanner 200 and the like. For example, in the processing of the step S115, instead of using the temperature inside the laser scanner Tscn and the average value aveTscn, the current temperature outside the apparatus Tout and the average value aveTout of the temperatures outside the apparatus may be used.

In the fourth embodiment as described, since the value to be stored in the memory 705 at the time of the overtime job can be updated while suppressing the increase in the downtime, the number of times to perform the auto registration in the pre-operation by the processing of the step S108 can be reduced. This realizes the further reduction of the downtime.

As described in the first to fourth embodiments, the image forming apparatus 100 of the present disclosure is capable of reducing the downtime by reducing the frequency to perform the auto registration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-169153, filed Sep. 10, 2018, which is hereby incorporated by reference herein in its entirety.

What is claimed is:

1. An image forming apparatus comprising:

a plurality of image forming units configured to form a plurality of images of different colors;

an intermediate transfer member to which the images are transferred;

a transfer unit configured to transfer the images on the intermediate transfer member to a sheet;

a sensor configured to measure color patterns on the intermediate transfer member, the color patterns being used to detect color misregistration;

a detector configured to detect a temperature;

a memory; and a controller configured to:

control the plurality of image forming units to form color patterns of different colors;

control the sensor to measure the color patterns;

detect the color misregistration on the basis of a measurement result of the sensor;

store data related to the color misregistration in the memory; and control a relative position of images to be formed by the plurality of image forming units on the basis of the latest data related to the color misregistration stored in the memory and a detection result of the detector, wherein the controller controls whether or not to perform an initial operation in which the color patterns are formed before an image is formed, in a case in which an elapsed time without image forming is longer than a predetermined time, wherein the controller controls, in a case which the initial operation in which the color patterns are formed is not performed, the relative position of images to be formed by the plurality of image forming units based on first data stored in the memory, second in the memory, and a detection result of the detector, wherein the first data corresponds to data related to a first color misregistration detected at a first initial operation that is previously performed, and wherein the second data corresponds to data related to a second color misregistration detected at a second initial operation that is performed earlier than the first initial operation.

2. The image forming apparatus according to claim 1, further comprising another detector, which is provided at a position different from the detector and configured to detect another temperature, wherein the controller is further configured to determine, based on a detection result of the other detector, whether or not to perform the initial operation in which the color patterns are formed before an image is formed, in a case in which an elapsed time without image forming is longer than the predetermined time.

3. The image forming apparatus according to claim 1, wherein the plurality of image forming units include a scanner unit configured to expose a photoreceptor provided in each of the plurality of image forming units, wherein the scanner unit comprises a light source and a mirror for deflecting light from the light source, and wherein the detector is provided in the scanner unit.

4. The image forming apparatus according to claim 1, wherein the memory is configured to store the temperature detected by the detector, wherein the controller controls whether or not to perform the initial operation based on a latest temperature detected by the detector, a first temperature detected at the first initial operation, and a second temperature detected at the second initial operation.

5. The image forming apparatus according to claim 1, wherein the controller controls, in a case in which the initial operation in which the color pattern is formed is not performed, the relative position of images to be formed by the plurality of image forming units based on first data stored in the memory, second data stored in the memory, a latest temperature detected by the detector, a first temperature detected at the first initial operation, and a second temperature detected at the second initial operation.

6. The image forming apparatus according to claim 1, wherein the controller controls, in a case in which the initial operation in which the color pattern is formed is performed, the relative position of images to be formed by the plurality of image forming units based on the latest data stored in the memory and a detection result of the detector.

* * * * *